US008272409B2

(12) United States Patent
Manzon et al.

(10) Patent No.: US 8,272,409 B2
(45) Date of Patent: Sep. 25, 2012

(54) METHODS, APPARATUS AND SYSTEMS FOR THE HANDLING OF EMPTY, FLAT FOLDED STORAGE BAGS IN PREPARATION FOR FILLING WITH A FLOWABLE MATERIAL

(75) Inventors: Vincent Rody Manzon, Chilliwack (CA); Jeffery Franklin Boyne, Surrey (CA); Ryan Stewart Maw, Abbotsford (CA); Stephen Douglas Erdman, Armstrong (CA)

(73) Assignee: Target Products Ltd., Burnaby (CA)

( * ) Notice: Subject to any disclaimer, the term of this patent is extended or adjusted under 35 U.S.C. 154(b) by 53 days.

(21) Appl. No.: 12/931,405

(22) Filed: Jan. 31, 2011

(65) Prior Publication Data

US 2012/0192527 A1 Aug. 2, 2012

(51) Int. Cl.
*B65B 43/42* (2006.01)

(52) U.S. Cl. ..... 141/10; 141/166; 141/314; 141/114; 53/459; 53/571; 271/106; 271/100; 198/468.4; 198/803.5

(58) Field of Classification Search ..... 141/314, 141/315, 316, 166, 114, 10; 53/571, 573, 53/459; 271/100, 101, 102, 104, 105, 106, 271/131, 137; 198/468.4, 803.5
See application file for complete search history.

(56) References Cited

U.S. PATENT DOCUMENTS

| | | | | |
|---|---|---|---|---|
| 2,332,187 A | | 10/1943 | Allen | |
| 3,050,918 A | * | 8/1962 | Helm et al. | 53/386.1 |
| 3,462,917 A | | 8/1969 | Shigeo | |
| 3,466,837 A | | 9/1969 | Sturges | |
| 3,691,715 A | * | 9/1972 | Kelly et al. | 53/459 |
| 3,715,858 A | * | 2/1973 | Durant et al. | 53/573 |
| 3,989,073 A | | 11/1976 | Remmert | |
| 4,122,649 A | | 10/1978 | Sawvel | |
| 4,141,392 A | | 2/1979 | Moltrasio | |
| 4,334,558 A | | 6/1982 | Durant | |
| 4,345,629 A | | 8/1982 | Inglett | |

(Continued)

FOREIGN PATENT DOCUMENTS

EP 0371955 6/1990

(Continued)

*Primary Examiner* — Timothy L Maust
*Assistant Examiner* — Timothy Kelly
(74) *Attorney, Agent, or Firm* — Lance A. Turlock

(57) ABSTRACT

Empty, flat folded storage bags which may be valve bags are prepared for filling with a flowable material, by seating and stacking a plurality of the bags on a fixed elevation base within a chamber of a bag holding magazine assembly, the resulting stack defining an initial stack rising from a lowermost one the bags on the base to an uppermost one of the bags. In a first cycle of operation, all but the lowermost bag is raised away from the base, the raised bags defining a depleted stack of bags. Then, while the depleted stack remains raised, the lowermost bag is removed from the chamber through a chamber outlet opening. Then, the depleted stack is lowered to seat a new lowermost bag on the base to complete first cycle. The cycle is repeated for each lowermost bag. When each bag is removed from the magazine chamber the bag may be conveyed to a bag pick-up position located away from the magazine assembly and, from there, automatically picked with a carrying tool located at the end of a robotic arm and transported to a bag filling station for filling with the flowable material. In the case of valve bags, the valve may be opened by the carrying tool at the time of pick-up.

41 Claims, 14 Drawing Sheets

U.S. PATENT DOCUMENTS

| | | | | |
|---|---|---|---|---|
| 4,442,874 | A * | 4/1984 | Ballard, Jr. | 141/166 |
| 4,577,454 | A | 3/1986 | Wright et al. | |
| 4,970,847 | A | 11/1990 | Gradwohl | |
| 5,050,651 | A | 9/1991 | Hejlesen | |
| 5,346,200 | A | 9/1994 | Sarvik et al. | |
| 6,705,606 | B2 | 3/2004 | Summa | |
| 6,976,350 | B2 | 12/2005 | Greening et al. | |
| 7,194,849 | B2 | 3/2007 | Komp | |
| 7,363,753 | B2 | 4/2008 | Gates | |
| 7,527,079 | B2 * | 5/2009 | Wadium et al. | 141/166 |
| 2008/0256905 | A1 * | 10/2008 | Graf | 53/459 |

FOREIGN PATENT DOCUMENTS

| | | |
|---|---|---|
| JP | 7215314 | 8/1995 |
| JP | 7277307 | 10/1995 |

* cited by examiner

| | |
|---|---|
| ——— | AIR LINE CONNECTION |
| - - - - - | ELECTRICAL CONNECTION |
| (P) | PROXIMITY SENSOR |
| ◎ | SUCTION CUP |
| ▭ | VACUUM GENERATOR |
| ▭ | PNEUMATIC CYLINDER |

METHODS, APPARATUS AND SYSTEMS FOR THE HANDLING OF EMPTY, FLAT FOLDED STORAGE BAGS IN PREPARATION FOR FILLING WITH A FLOWABLE MATERIAL

FIELD OF THE INVENTION

The present invention relates to methods, apparatus and systems for the handling of empty, flat folded storage bags in preparation for filling with a flowable material. Flowable material includes powdery materials such as cement powder, particulate material such as sands, seeds, pelletized material, etc.

The invention is considered particularly suited for though not limited to the handling of flat folded valve bags; that is, bags which have a flat-folded filling valve at one end of the bag.

BACKGROUND OF THE INVENTION

There are numerous automated systems for the handling of empty, flat folded storage bags in preparation for filling with a flowable material. Many include a magazine assembly having a chamber in which bags to be filled are initially stacked, then sequentially removed or fed from the chamber and transported by various means to a filling station. Some systems involve one-by-one removal of bags from the top of a magazine chamber. Others involve one-by-one removal of bags from the bottom of a magazine chamber.

Examples of systems where stacked bags are automatically removed from the top of a magazine chamber include those disclosed in U.S. Pat. No. 3,466,837 (Sturges) granted on Sep. 16, 1969; U.S. Pat. No. 4,970,847 (Gradwohl) granted on Nov. 20, 1990; U.S. Pat. No. 5,050,651 (Hejlesen) granted on Sep. 24, 1991; and U.S. Pat. No. 7,194,849 (Komp) granted on Mar. 27, 2007.

Examples of systems where stacked bags are automatically removed from the bottom of a chamber include those disclosed in U.S. Pat. No. 2,332,187 (Allen) granted on Oct. 19, 1943; U.S. Pat. No. 3,989,073 (Remmert) granted on Nov. 2, 1976; U.S. Pat. No. 4,345,629 (Inglett) granted on Aug. 24, 1982; U.S. Pat. No. 6,705,606 (Summa) granted on Mar. 16, 2004; and Japanese Publication No. JP 7277307A (Sakai) published on Oct. 24, 1995.

Various problems can arise in the operation of such systems.

One potential problem is adherence between adjacent bags. For example, two bags may be held together by a small spot of leaked glue. The strength of adherence may be weak, but nevertheless sufficient to compromise automated one-by-one removal of bags from a magazine chamber.

Another potential problem involves the flatness of the bags. Merely because the bags are "flat folded" does not mean they are flat or will lie in flat planes atop one another when stacked in a chamber. Their surfaces may have some bowing, rippling or other distortion away from planar flatness. Such distortions can compromise reliable separation and dispensing of individual bags from the chamber.

A further potential problem with many known systems is the lack of a suitable operating strategy in the event there is a malfunction in the mechanisms used to transport bags from a magazine assembly to a bag filling station. Even though the magazine assembly may remain serviceable, a failure in the transport mechanism may dictate a complete system shutdown. This problem can arise, for example, in a system like that of Sturges, supra, where bags are gripped and removed from the top of a magazine chamber and, with the same mechanism, are then transported directly to a bag filling station. As another example, it can also arise with a system like that of Sakai, supra, where bags are gripped and removed from the bottom of a magazine chamber and, with the same mechanism, are then transported directly to a bag filling station.

In the case of flat folded valve bags, other problems can arise—for example, the reliable opening of valves to enable filling at a bag filling station. Typically, the mechanism which is used to transport a valve bag to a bag filling station will include a means to open the valve at the time it grips the bag. The transport mechanism then steers the bag with its opened valve over a filling nozzle at the bag filling station. However, if the nozzle encounters a bag with a valve which is incompletely opened, and if the problem cannot be corrected, then the bag has to rejected. In an automated system, it is obviously desirable to minimize the frequency of such occurrences. This requires consideration not only of the mechanism used to open valves but also the manner in which bags are presented to the bag filling station.

As another example in the case of flat folded valve bags, the manner in which the bags are stacked in a magazine chamber can become an issue. The thickness of each flat folded bag typically may not be uniform along the length of the bag. When stacked on top of one another in a magazine chamber, the result can be a stack where the upper bags in the stack progressively become more and more tilted within the chamber as the number of bags is increased—eventually to an unworkable degree which limits the addition of more bags to the stack.

Various aspects of the present invention address the foregoing issues. Generally, there is a need for new and improved methods and apparatus for handling empty, flat folded storage bags, including flat folded valve bags, in preparation for filling with a flowable material. The need exists not only from an overall system point of view beginning with the structure and operation of a bag holding magazine assembly and ending with the presentation of empty bags to a bag filling station, but also in relation to intermediate stages of handling.

SUMMARY OF THE INVENTION

In one aspect of the method of the present invention there is provided a method of handling empty, flat folded storage bags in preparation for filling with a flowable material, the method comprising seating and stacking a plurality of the bags on a fixed elevation base within a chamber of a bag holding magazine assembly, the resulting stack defining an initial stack rising from a lowermost one the bags on the base to an uppermost one of the bags. Then, in a first cycle of operation, all but the lowermost bag is raised away from the base, the raised bags defining a depleted stack of bags. Then, while the depleted stack remains raised, the lowermost bag is removed from the chamber through a chamber outlet opening. Then, the depleted stack is lowered to seat a new lowermost bag on the base. This completes the first cycle of operation. The first cycle is then repeated for each lowermost bag.

It may be noted that the system of Sakai, supra, contemplates a magazine chamber where the base on which bags are stacked does not have a fixed elevation. Rather, the base is repeatedly lowered and raised as stacked bags are sequentially removed from the chamber. When the base is lowered, it is lowered carrying with it the lowermost bag in the stack to align with a pair of clamping jaws designed to grip on an end of the lowermost bag. During the step of lowering, each lowermost bag needs to be held to the base by bag gripping means which move up and down with the base. The jaws are then operated to pull the lowermost bag from the chamber and to carry the bag to a bag filling station. All remaining bags remain stacked in their original position within the chamber. When the base is subsequently raised, the remaining stack becomes seated on the base. The repeated raising and lowering of the base, including the requirement to maintain a grip on the lowermost bag, is dictated by the necessity to repeatedly align lowermost bags with the clamping jaws. The present invention does not involve such criteria.

In a further aspect of the method of the present invention, each lowermost bag removed from the magazine chamber is removed by feeding the bag to an outlet opening in the chamber, then conveying the bag through the opening to a bag pick-up position located away from the magazine assembly. Generally, the prior art (including Sakai, supra) does not appear to contemplate an intermediate pick-up position. It appears to contemplate grabbing a bag from a magazine chamber and transporting it directly to a bag filling station. Such systems are considered to be undesirable. If the transport mechanism fails, then the result may be a complete system shutdown. On the other hand, with an intermediate pick-up station, if a system for automated pick-up fails, then a system for manual pick-up can be substituted during the time when maintenance procedures may be required. In short, operations may carry on despite partial failure of the system.

In another aspect of the method of the present invention, each lowermost bag is removed from the magazine chamber by conveyance through an outlet opening in the chamber to a pick-up position located on a bag transfer station. The method further comprises automatically lifting the bag away from the pick-up position and carrying the lifted bag to a bag filling station for filling flowable material.

The bags mentioned above may be valve bags which have an openable flat-folded filling valve at one of their ends.

In yet another aspect of the method of the present invention, the method further comprises opening the filling valve of each bag at its pick-up position before carrying the bag to a filling station. Opening may be achieved by applying suction to a top surface of the valve while momentarily holding the bag in its pick-up position. Preferably, the suction holds the valved end of the bag in a valve shaping channel member of a bag carrying tool with the filling valve fully opened, the channel member comprising an elongated top and opposed sides extending downwardly and outwardly from the top to an open bottom; and wherein the suction is maintained while carrying the lifted bag to the bag filling station.

In yet a further aspect of the method of the present invention the magazine chamber described above extends front to back between a chamber forward end and a chamber rearward end, and transversely between opposed chamber sides. Each lowermost bag removed from the chamber is removed through an outlet opening in the rearward end. Preferably, the distance between sides of the chamber is adjustable.

In a still further aspect of the method of the present invention it has been found that bags when stacked in a magazine chamber can, to advantage, be stacked in groups of bags with longitudinal staggering between the groups. Particularly in the case of valve bags or other bags which have unequal flat folded thicknesses along their length, staggering can reduce the amount of progressive tilt mentioned above thereby enabling more bags to be stacked without encountering excessive tilt.

In a further aspect of the present invention, there is provided a magazine assembly for handling and sequentially supplying bags from a stack of empty, flat folded storage bags in preparation for filling with a flowable material, each bag having opposed ends and opposed sides extending between the ends, and each bag having opposed top and bottom surfaces between the ends. The stack extends upwardly from a lowermost one of the bags to an uppermost one of the bags. The magazine assembly comprises a chamber for holding the stack, a fixed elevation base, an elevator mechanism and a bag removal mechanism.

The magazine chamber extends front to back between a forward end of the chamber and a rearward end of the chamber, and transversely between opposed sides of the chamber. The rearward end provides an outlet opening permitting removal of bags in the stack from the chamber through the opening. Preferably, the chamber sides are distanced from each other by an adjustable amount.

The base has an upper surface for providing a seating for the stack within the chamber with the lowermost bag resting on the base. The upper surface is aligned with the outlet opening.

The elevator mechanism is for selectively raising within the chamber all but the lowermost bag while holding the lowermost bag on the base, the raised bags defining a depleted stack of bags, and for lowering and seating the depleted stack on the base when the lowermost bag has been removed from the chamber.

The bag removal mechanism is for removing the lowermost bag from the chamber through the outlet opening while the depleted stack remains raised.

Preferably, the elevator mechanism comprises a pair of elevator guides, one positioned outside one side of the chamber, the other positioned outside the opposite side of the chamber, a pair of elevator trucks, and gripper mechanisms for gripping and downwardly bending the opposed sides of the lowermost bag when the bag is rested on the base. The trucks each have a forward end comprising a plurality of lifting forks positioned between opposed sides of the truck. The trucks are carried and guided by respective ones of the guides for reciprocal movement in unison between lower positions where the forks are distanced away from the chamber and upper positions where the forks project into the chamber.

The elevator mechanism is disposed such that as the trucks move upwardly from lower positions to upper positions when the opposed sides of the lowermost bag are bent downwardly, then the forks bypass the lowermost bag and engage the stack below the bag next above the lowermost bag, such engagement occurring before the trucks reach maximally upward positions.

Advantageously, the forks on each truck project inwardly relative to the chamber at a downward angle (e.g. about 6 degrees). To further advantage, the forks on each truck have lengths which vary from relatively short lengths for those ones of the forks positioned towards opposed sides of the truck to longer lengths for those ones of the forks positioned midway between truck sides.

The gripper mechanisms may comprise a first plurality of pivotally mounted suction cups for releasably applying suction grips at a first plurality of locations on the bottom surface of one side of the lowermost bag, and a second plurality of pivotally mounted suction cups for concurrently releasably applying suction grips at a second plurality of locations on the bottom surface of the opposed side of the lowermost bag. As an enhancement to the gripper mechanisms, there may be provided plungers for momentarily urging the bottom surface of the lowermost bag against the suction cups when suction is applied. This better ensures that when suction is applied it will be effective.

The fixed elevation base may comprise a pair of longitudinally extending rails, each rail having an upper surface forming part of the upper surface of the base. The bag removal mechanism may comprise a feed mechanism for feeding the lowermost bag along the rails to the outlet opening of the chamber and means for conveying the lowermost bag through the outlet opening. Advantageously, the means for conveying the lowermost bag through the outlet opening includes upper and lower cooperating rollers for rotationally grasping and drawing the bag through the opening. To further advantage, the upper rollers are preferably crowned pinch rollers.

In a further aspect of the present invention, there is provided apparatus which comprises, in combination with the magazine assembly described above, a bag transfer station for receiving each lowermost bag removed through the outlet opening of the magazine assembly and for conveying the received bag to a pick-up position on the station. From this position, bags may be automatically picked up by suitable means and transported to a bag filling station for filling with flowable material. However, in the event of some failure in the automatic means, the bags may be manually picked up and transported to the bag filling station. The automatic means preferably comprises a robotic arm with a bag carrying tool mounted at a distal end of the arm.

In the case of valve bags, the transfer station and carrying tool are preferably adapted to cooperatively open the valve when the bag is picked up from the transfer station using the robotic arm. Advantageously, the carrying tool comprises a valve shaping channel member into which the valved end of each of the bags is drawn and held when picked up from the transfer station, the channel member comprising an elongated top and opposed sides extending downwardly and outwardly from the top to an open bottom.

The foregoing and other features and advantages of the present invention will now be described with reference to the drawings.

DETAILED DESCRIPTION OF THE INVENTION

Overall, the bag handling apparatus shown in the figures is adapted to handle flat folded valve bags. However, as indicated below, parts of the apparatus may be used for the handling of flat folded bags which are not valve bags.

Figure 8:
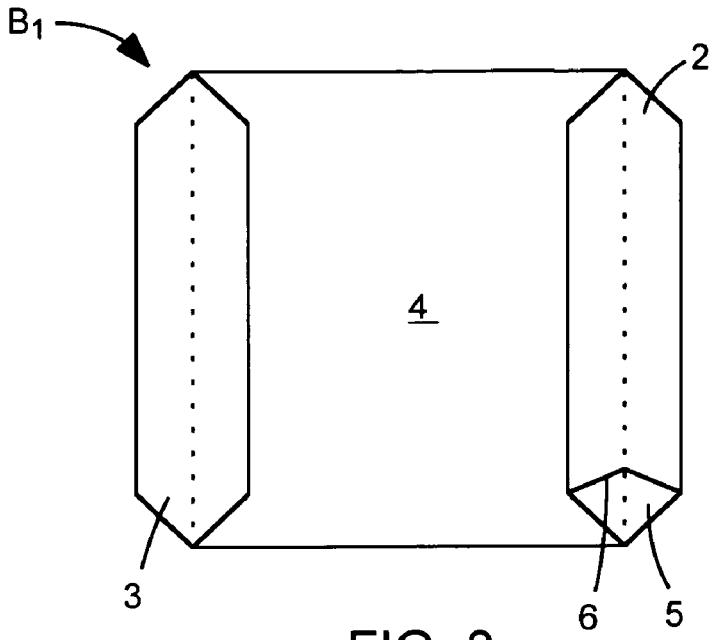
FIG. 8 is a representative plan view of a conventional flat folded valve bag laying flat with its valve fully closed.
Figure 9:
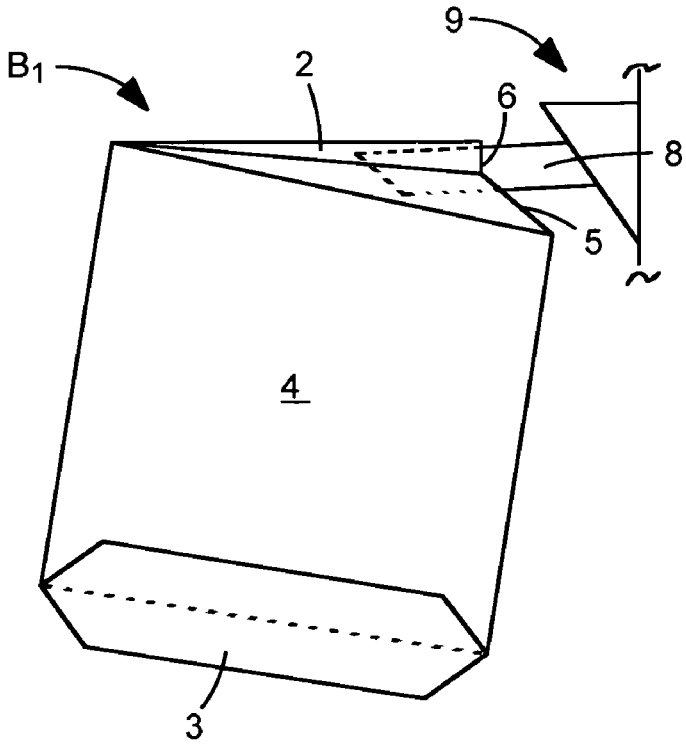
FIG. 9 is an elevation view of the bag shown in FIG. 8 when positioned with its valve open on the filling nozzle of a bag filling station.

To provide a point of reference, FIGS. 8 and 9 illustrate a conventional flat folded valve bag generally designated $B_1$. The bag includes a top or valved end 2, a bottom end 3 and opposed sides extending between ends 2, 3. Only one of the sides (side 4) is visible. Valved end 2 includes a lip 5 which leads to a valve entrance 6. FIG. 9 illustrates bag $B_1$ when positioned with its valve open on filling nozzle 8 of a conventional bag filling station generally designated 9. A method whereby the bag may be so positioned is described below.

Magazine Assembly

Referring now to FIGS. 1-4, there is shown a bag magazine assembly generally designated 20 for handling and sequentially supplying bags from a stack of empty, flat folded storage bags like bag $B_1$ shown in FIG. 8 in preparation for filling with a flowable material (e.g. cement powder), Also shown is a transfer station generally designated 30 for receiving bags removed from the magazine assembly. In the case of valve bags, they may be subsequently transported from station 30 to a bag filling station like station 9 shown in FIG. 9 for filling with flowable material.

Magazine assembly 20 comprises a magazine chamber 200 which extends longitudinally between a forward end 201 and a rearward end 202, and transversely between opposed sides 203, 204. Opposed flanges 206, 207 extend backwardly from side 203.

Figure 1:
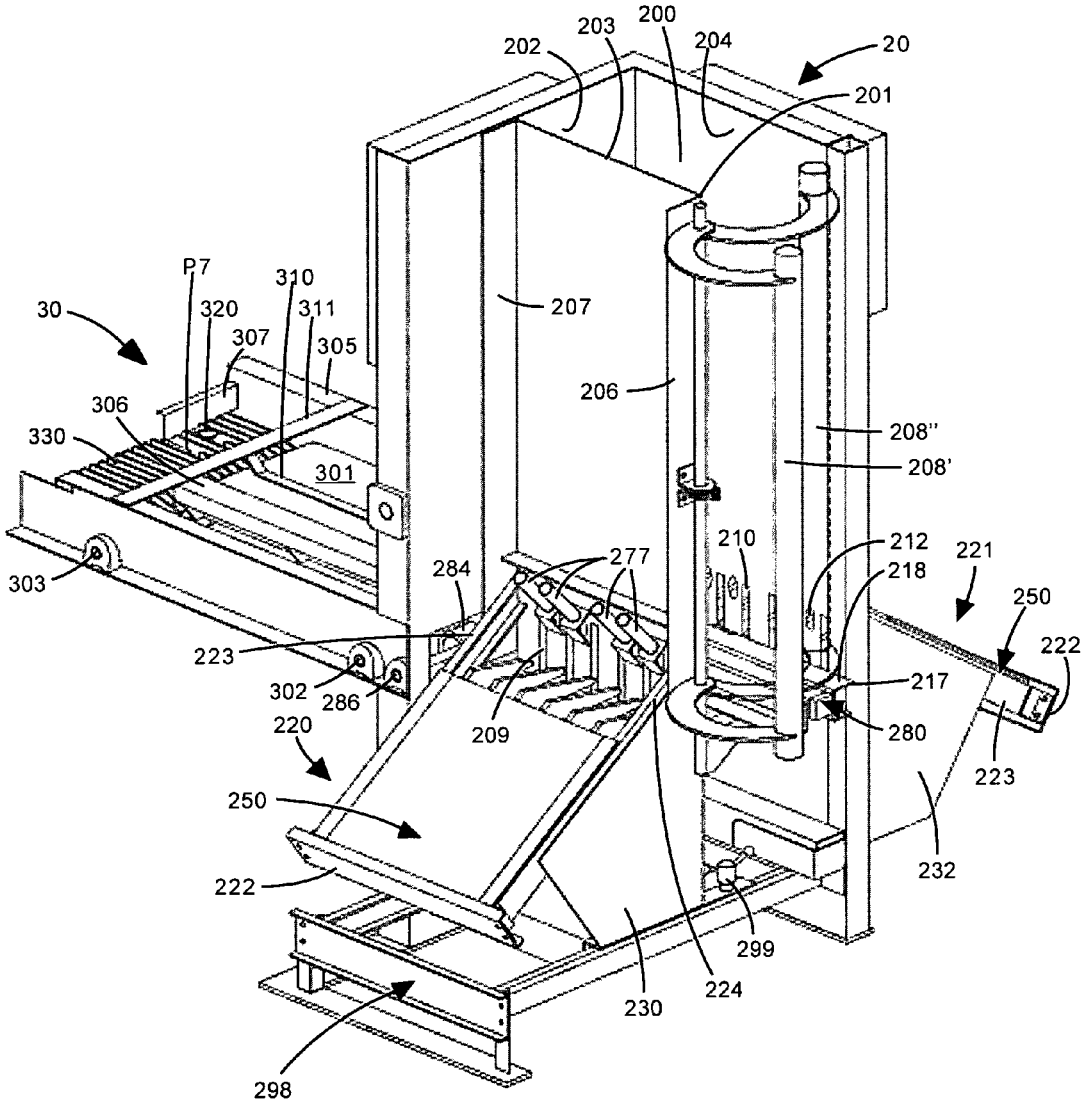
FIG. 1 is a forward end perspective view of bag handling apparatus including a magazine assembly and a bag transfer station in accordance with the present invention.
Figure 4:
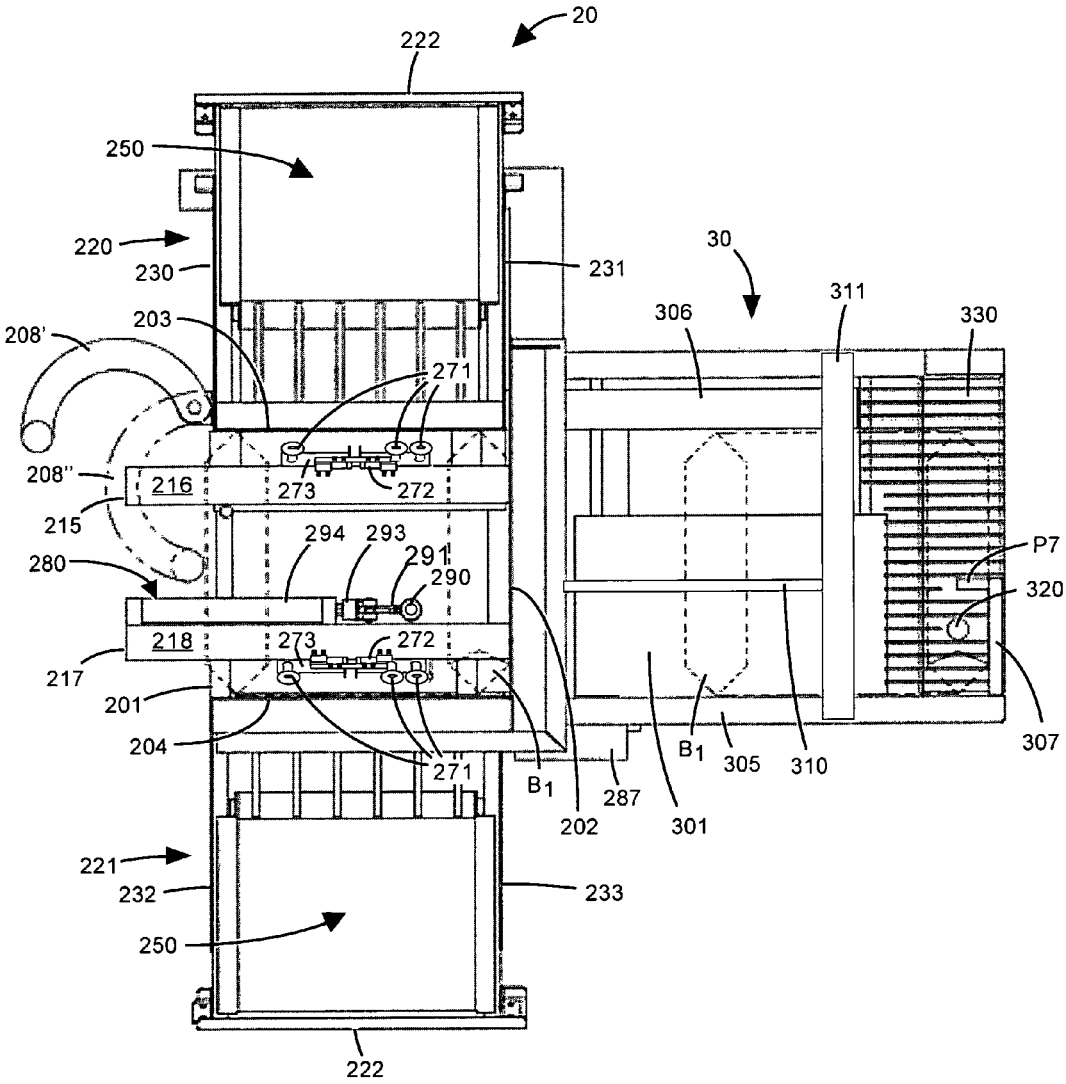
FIG. 4 is a top view of the apparatus shown in FIG. 1. For the purpose of illustrating use of the invention, a flat folded valve bag is shown in broken outline in first and second positions in this drawing, but the bag itself is not part of the invention.

Flange 206 provides support for a containment gate 208 (208', 208") which is hingedly mounted to the flange and is manually swingable between open and closed positions. In FIGS. 1 and 4, the designation 208' identifies the gate in its open position; 208" identifies the gate in its closed position. In the open position, bags can be easily loaded into chamber 200 through forward end 201. In the closed position, the gate assists to contain bags within the chamber. The degree of swing between open and closed position will depend on the length of bags placed in the chamber. Flange 207 slidably abuts rearward end 202 of the chamber.

Magazine assembly 20 also includes a base formed by spaced apart rails 215, 217 which extend between forward end 201 and rearward end 202 of chamber 200. The rails have flat upper surfaces 216, 218 which together provide a seating for bags stacked in the chamber. The elevation of surfaces 216, 218 with respect to chamber 200 is fixed. On the left side of FIG. 4, the placement of valve bag $B_1$ within chamber 200 atop rail surfaces 216, 218 is shown in broken outline.

It will be understood that the bags stacked in chamber 200 need not be valve bags. Bags other than valve bags can be stacked in chamber 200 and the lowermost bag removed from the chamber in the manner described below.

Also, while preferable, it will be understood that the use of rails with flat upper surfaces is not considered to be essential. For example, rails 215, 217 could be replaced by cylindrical pipes or rods. Nevertheless, rails with flat upper surfaces are preferred because they will provide a broader area of underlying support for a stack of bags seated on the rails. Such support is considered to enable a more reliable separation of a lowermost bag from bags stacked above a lowermost bag.

Elevator Mechanism

Magazine assembly 20 further includes an elevator mechanism to selectively raise within chamber 200 all but the lowermost bag in a stack of bags while holding the lowermost bag on the base provided by rails 215, 217. The elevator mechanism comprises an opposed pair of elevator guides generally designated 220, 221. Guide 220 is welded between downwardly sloping opposed support walls 230, 231 which extend perpendicularly away from side 203 of the chamber. Wall 230 is integrally formed with flange 206. Wall 231 is integrally formed with flange 207. Guide 221 is welded between downwardly sloping opposed support walls 232, 233 which extend perpendicularly away from side 204 of the chamber. Each guide carries an elevator truck generally designated 250. The elevator mechanism also comprises bag gripper mechanisms generally designated 270 which are best seen in FIGS. 10-14 and which are described below in more detail.

The structure of guide 221 is substantially the same as guide 220 and they have a mirror image relationship with each other. However, it will be noted that guide 220 and its elevator truck 250, together with side 203 of magazine assembly 20 and other elements associated with side 203, including rail 215, are slidably carried on an underlying framework generally designated 298 (see FIG. 1). In contrast, the position of guide 221 and its elevator truck, together with side 204 and other elements associated with side 204, is fixed. The slidable feature enables the distance between sides 203 and 204 to be adjusted to accommodate flat folded bags of differing sizes. A tightener 299 is provided to releasably secure side 203 in a desired position with respect to side 204. When the distance is changed, flange 207 slides across rearward end 202 of chamber 200.

Figure 5:
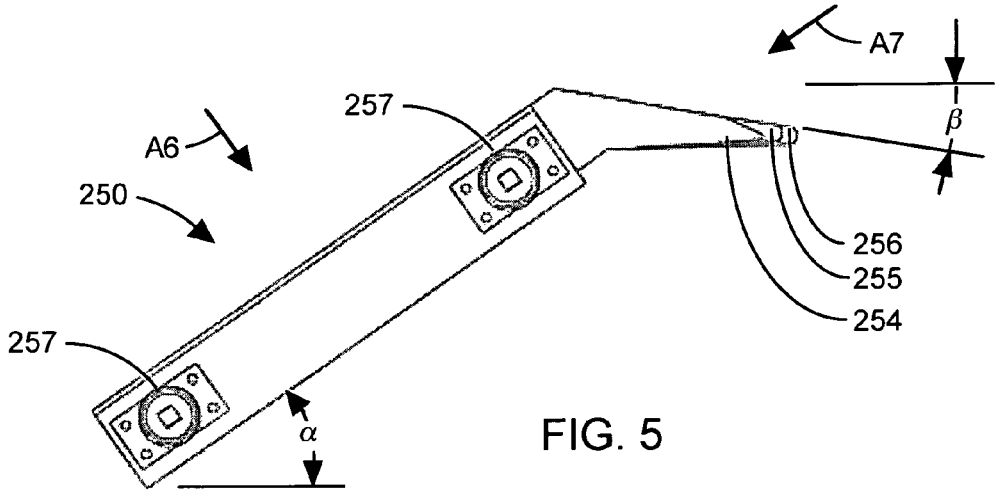
FIG. 5 is a side elevation view of an elevator truck forming part of the magazine assembly shown in FIGS. 1-4.
Figure 6:
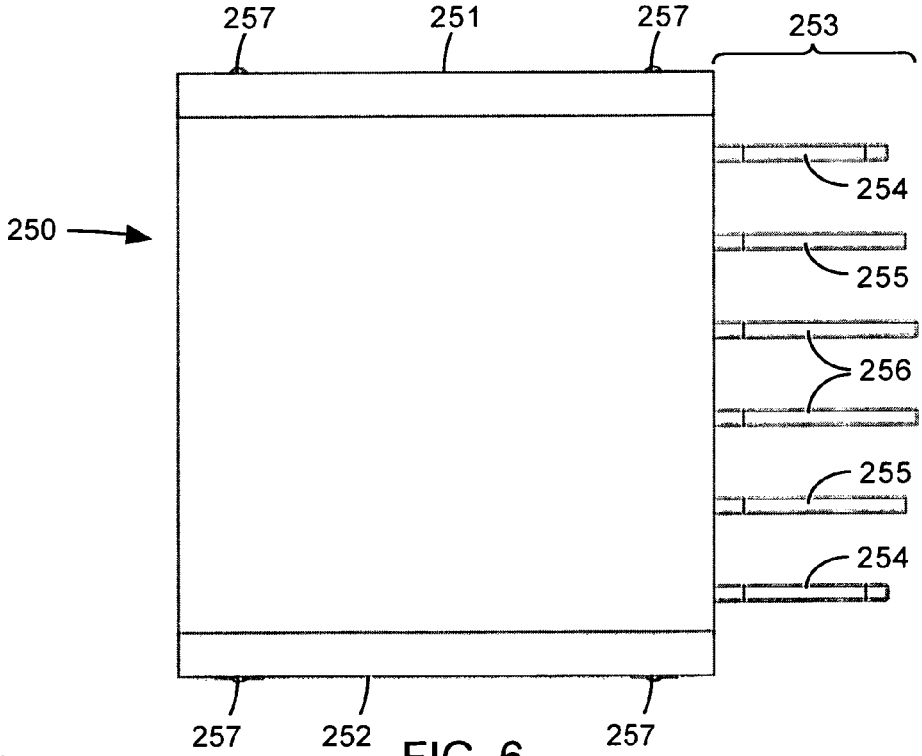
FIG. 6 is a top view of the truck shown in FIG. 5, looking generally in the direction indicated by arrow A6 in FIG. 5.
Figure 7:
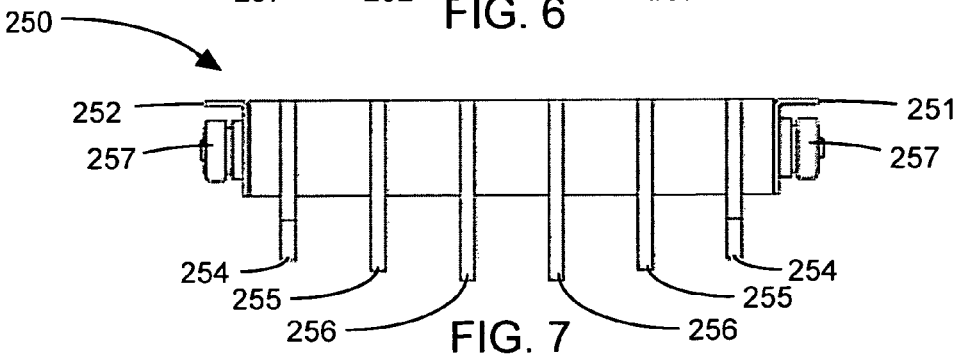
FIG. 7 is an end view of the truck shown in FIG. 5, looking generally in the direction indicated by arrow A7 in FIG. 5.

In more detail, each elevator guide 220, 221 comprises a lower end 222 and an opposed pair of rectangular channel members 223, 224, the latter of which extend in parallel at an angle upwardly and inwardly from lower end 222 towards chamber 200. As best seen in FIGS. 5-7, each elevator truck includes opposed parallel sides 251, 252 and a forward end 253 comprising six lifting forks positioned between the sides (i.e. two each of forks 254, 255, 256). Each side 251, 252 includes a pair of rollers 257 on which the truck rides at an angle $\alpha$ (alpha) in channel members 223, 224 of the associated guide. The precise angle $\alpha$ is not considered critical, but is preferably about 35 degrees.

Forks 254-256, are of differing lengths; the lengths varying from relatively short lengths for those ones of the forks positioned towards sides 251, 252 (i.e. forks 254) to longer lengths for those ones of the forks positioned midway between the sides (i.e. forks 256). Such varying lengths are not considered to be essential. However, they have been found to contribute to a more reliable separation of a lowermost bag from a stack of bags within chamber 200 when the bags are not contained in an ideally flat condition.

Also, it will be noted that forks 254-256 project downwardly at a relatively small angle $\beta$ (beta). In the present embodiment, the angle is about 6 degrees. The provision of this feature (as opposed to having no downward angle) is likewise not considered to be essential. However, it too has been found to contribute to a more reliable separation of a lowermost bag from a stack of bags within chamber 200 when the bags are not contained in an ideally flat condition.

Figure 2:
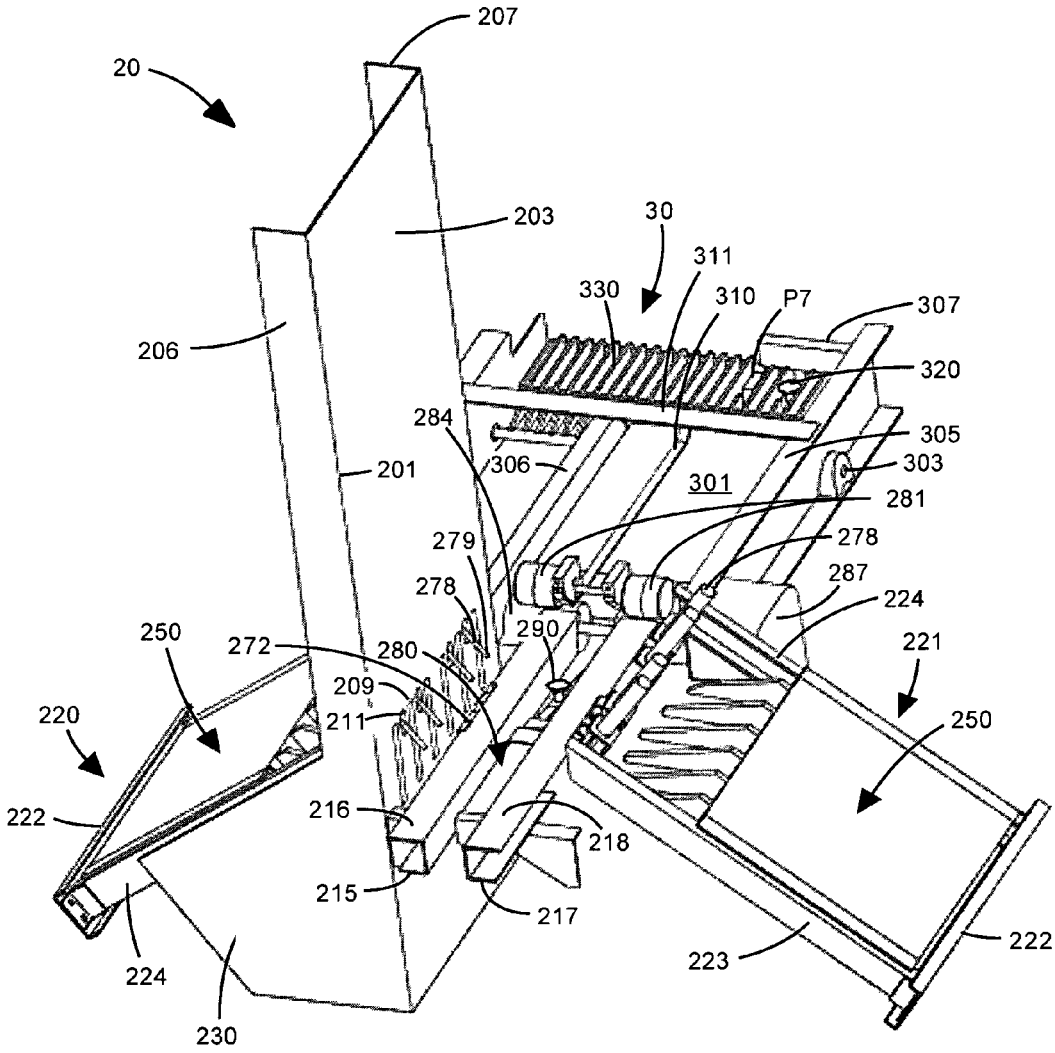
FIG. 2 is another forward end perspective view of the apparatus shown in FIG. 1. Some of the elements which appear in FIG. 1 having been omitted for the purpose of clarity.
Figure 3:
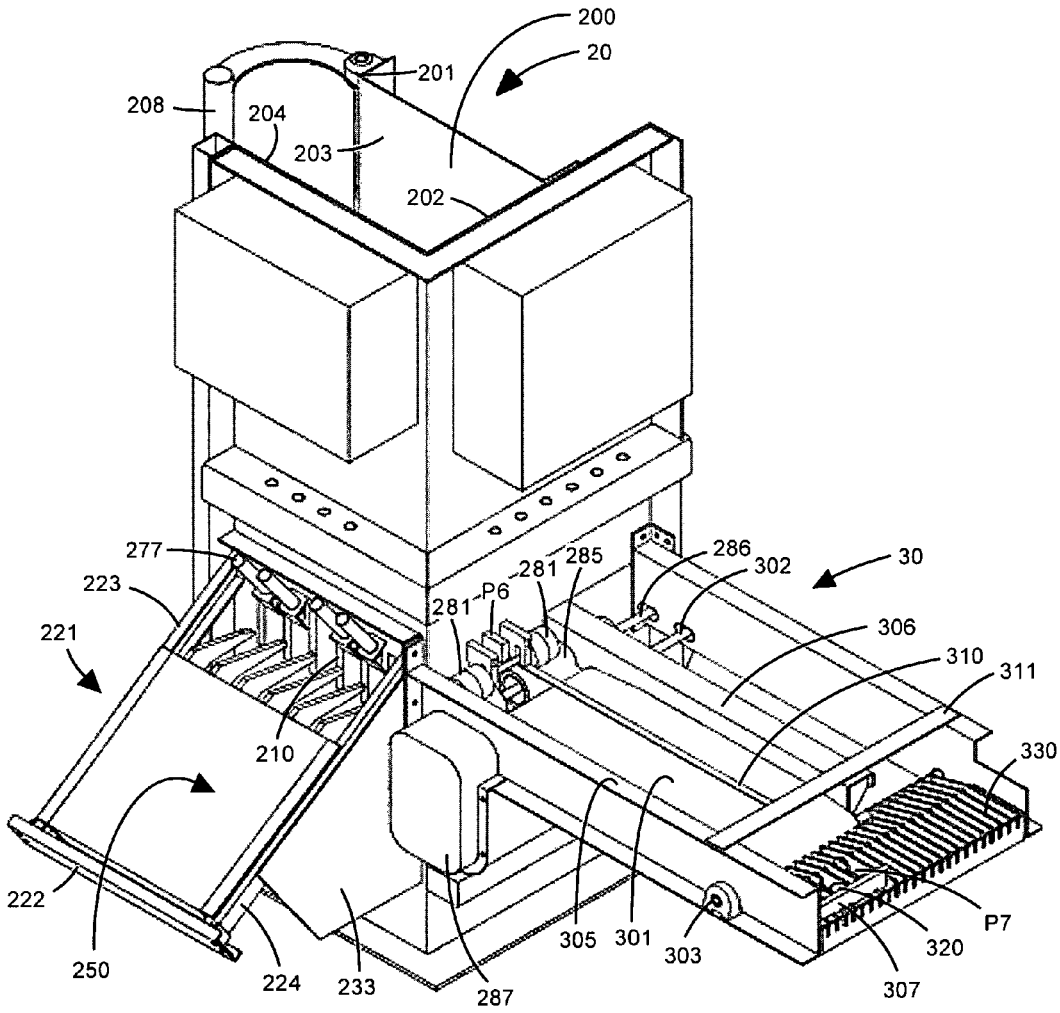
FIG. 3 is a rearward end perspective view of the apparatus shown in FIG. 1.
Figure 12:
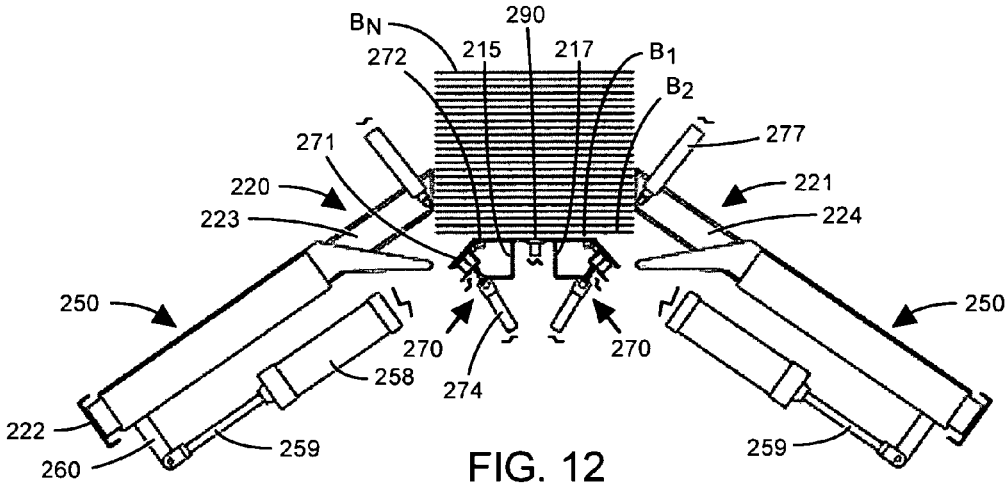
Figure 13:
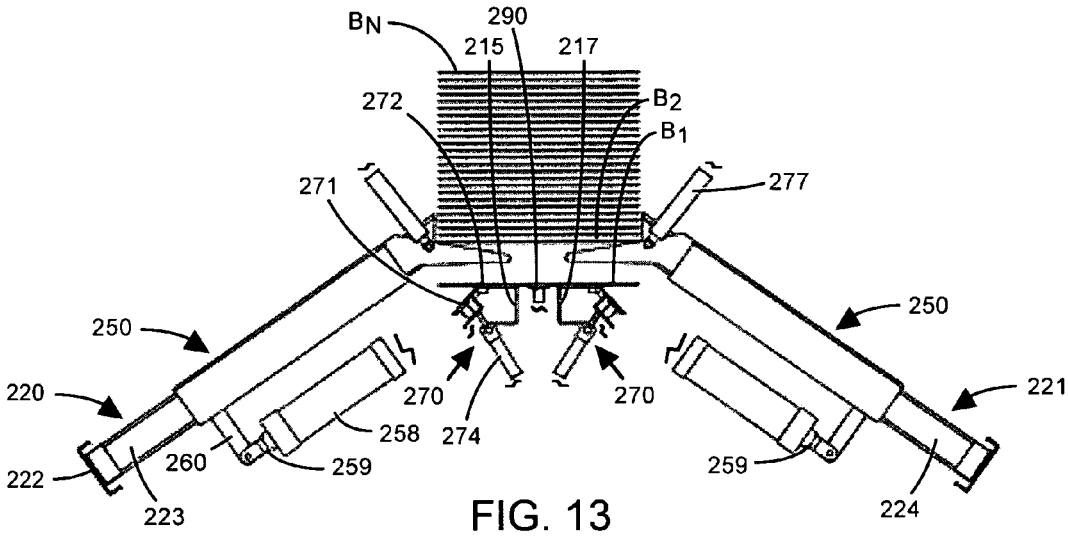
Figure 14:
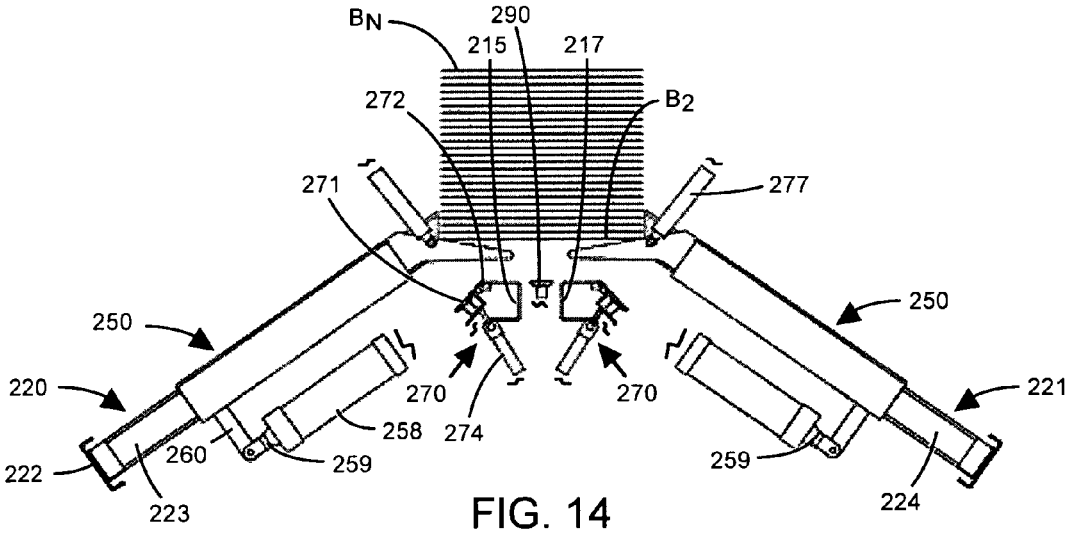

In operation, trucks 250 are reciprocally moved upwardly and downwardly along their associated guides in unison between lower positions (see e.g. FIGS. 10-12) and upper positions (see e.g. FIGS. 13-14). As best seen in FIGS. 1 and 2, side 203 of chamber 200 includes six vertically extending generally rectangular slots 209 (only one of which is labelled in the drawings) to allow passage of the lifting forks associated with left hand truck 250 into chamber 200 during such movements. Similarly, as best seen in FIGS. 1 and 3, side 204 includes six slots 210 (only one of which is labelled) to allow passage of the lifting forks associated with the opposed truck 250 into chamber 200.

Figure 10:
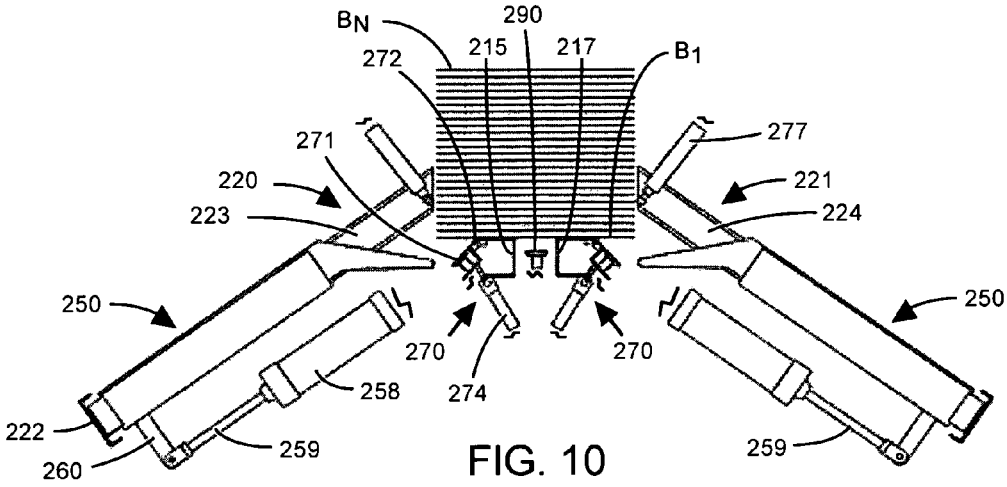
FIGS. 10 to 14 are elevation views showing at several stages the operation of the elevator mechanism forming part of the apparatus show in FIGS. 1-4. For the purpose of clarity, a number of elements of the magazine have been omitted. A representative stack of bags has been added.
Figure 11:
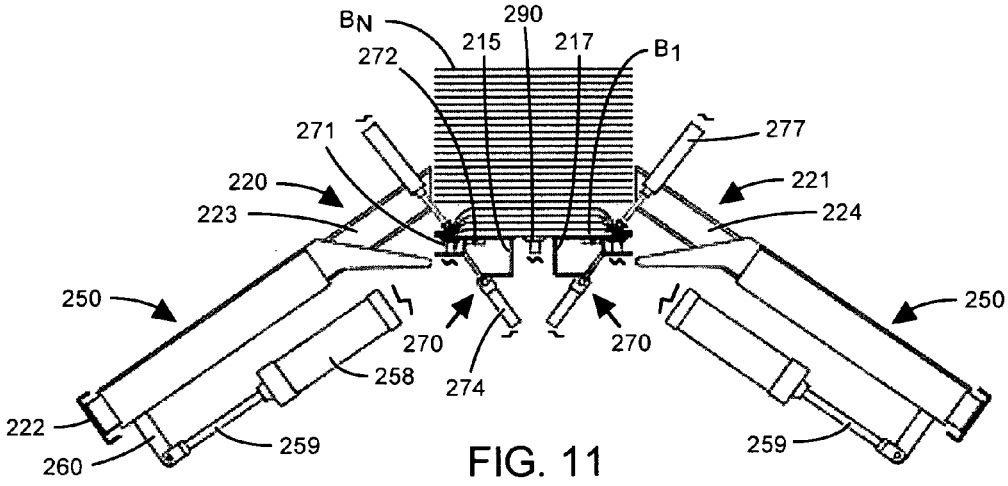

FIGS. 10-12 depict an upwardly extending stack of N bags $B_1 \ldots B_N$ when stacked in the magazine chamber on the base provided by rails 215, 217. Bag $B_1$ is the lowermost bag. Bag $B_N$ is the uppermost bag. FIG. 13 illustrates the situation when all bags except lowermost bag $B_1$ have been raised above the base by the elevator mechanism; the raised bags defining a depleted stack of N−1 bags $B_2 \ldots B_N$. FIG. 14 illustrates the situation when bag $B_1$ has been removed from the magazine chamber by the bag removal mechanism described below.

It should be noted that the stacked bags as illustrated in FIGS. 10-14 appear absolutely flat, one atop the other. In practice this may very well not be the case. As noted above, their surfaces may have some bowing, rippling or other distortion away from planar flatness.

The movement in unison of elevator trucks 250 is controlled by the concurrent operation of pneumatic cylinders 258 shown in FIGS. 10-14 where only the left hand cylinder has been labelled. Each cylinder includes a cylinder rod 259 which is coupled to its associated truck 250 by means of a link 260. When rods 259 are fully extended as shown in FIGS. 10-12, trucks 250 are in their lowermost positions on guides 220, 221. When the rods are fully retracted as shown in FIGS. 13-14, they are in their uppermost positions.

Referring now to bag gripper mechanisms 270 of which there are two, one of such devices is mounted to rail 215. The other is mounted to rail 217. Generally, their function is to grip and downwardly bend opposed sides the lowermost bag in the magazine chamber when the bag is on the base provided by rails 215, 217.

Figure 15:
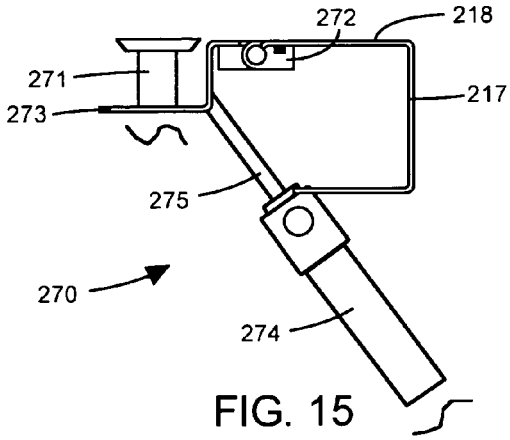
FIG. 15 is an enlarged side elevation view of a rail and bag gripper mechanism forming part of the elevator mechanism shown in FIGS. 10-14.

In more detail, FIG. 15 provides an enlarged view of the gripper mechanism 270 which is associated to rail 217 as shown in FIG. 11. The opposed gripper mechanism associated with rail 215 is substantially a mirror image. Mechanism 270 includes three suction cups 271 pivotally carried on the stepped arm 273 of a hinge 272 which is mounted to the rail. Only one of the cups is visible in FIG. 15, the other two being hidden from view directly behind the one which is visible. In this regard, it will be understood that hinge 272 is an elongated structure: see e.g. FIG. 4. Pivotal movement of hinge 272 and suction cups 271 together therewith is controlled by the operation of a pneumatic cylinder 274, the cylinder rod 275 of which is coupled to the arm of hinge 272. In FIG. 15, rod 275 is fully extended and the top of arm 273 extends flush upper surface 218 of rail 217. The elevation of cup 271 is slightly above that of surface 218. When rod 275 is retracted, then arm 273 with cup 271 rotate downwardly. Retracted positions are shown in FIGS. 10 and 12-14.

In the present embodiment, the gripping mechanism has been enhanced with the inclusion of plungers 277, each having a plunger rod 278 with a distal end 279. These plungers are basically pneumatic cylinders, however they are referred to herein as plungers because their cylinder/plunger rods are simply extended and retracted without connection to any other element of the magazine assembly. The present embodiment includes eight such plungers; four of which are mounted outside side 203, the other four of which are mounted outside wall 204 in a mirror image relationship. Only some have been labelled in the drawings.

Normally, plunger rods 278 are retracted to positions outside magazine chamber 200. When extended as shown by way of illustration in FIG. 2, they project into chamber 200. To allow passage of the four plungers associated with side 203, that side includes four generally elliptical openings 211 as indicated in FIG. 2 (only one of which openings and one of which rods is labelled). Similarly, to allow passage of the four plungers associate with side 204, that side include four generally elliptical openings 212. One of such openings has been labelled in FIG. 1.

The purpose of plungers 277 is to engage a stack of bags contained within magazine chamber 200 and to momentarily urge the bottom surface of the lowermost bag against suction cups 271 when the suction cups are in a raised position. However, as indicated below and in the drawings, this does require that the plungers act directly on the lowermost bag. The inclusion of plungers 277 has been found to better ensure that a sound suction grip will be achieved when suction is applied by cups 271 and to contribute to a more reliable separation of the lowermost bag from the stack—and again recognizes that bags stacked in chamber 200 may not be contained in an ideally flat condition.

The stages of operation of the elevator mechanism as represented by the positions shown in FIGS. 10-14 are generally as follows:

Stage 1 (FIG. 10): This is the beginning stage of a cycle of operation. A stack of N bags $B_1 \ldots B_N$ has been seated atop rails 215, 217 in the magazine chamber. Elevator trucks 250 are at their lowermost positions. Cylinders 274 are inactive, their cylinder rods being normally retracted. Suction cups 271 are in downwardly rotated positions and suction has not been applied. Plungers 277 are inactive, their plunger rods being normally retracted.

Stage 2 (FIG. 11): Elevator trucks 250 remain at their lowermost positions. Both cylinders 274 and plungers 277 have been activated. The activation of cylinders 274 has rotated suction cups 271 upwardly to engage opposed bottom sides of lowermost bag $B_1$. The plunger rods of plungers 277 have extended to angularly engage and bear down against a lower part of opposed sides of the stack—thereby compressing and forcing these sides downwardly towards rails 215, 217. It may be noted that that the engagement as shown in FIG. 11 is not with the lowermost bag. It is not essential that this be so. Indeed, and again by reason of distortions away from ideal planar flatness which may be present in bags within a stack of bags, it could be very difficult to control plungers 277 so that only the lowermost bag is engaged when the plunger rods are extended. The basic requirement is that wherever the plunger rods engage the stack they do so in sufficient proximity to lowermost bag $B_1$ such that the effect of transmitted forces is sufficient to urge edges of the bottom surface of bag $B_1$ against the suction cups. Then, the overall result is to better ensure that suction cups 271 reliably grip bag $B_1$ when suction is applied. At this stage, the next step is to apply suction to suction cups 271 thereby causing the cups to grip opposed bottom sides of bag $B_1$.

Stage 3 (FIG. 12): Elevator trucks 250 remain at their lowermost positions. Cylinders 274 and plungers 277 have been deactivated. However, the suction applied to suction cups 271 has been maintained. Consequently, the opposed sides of lowermost bag $B_1$ have been bent downwardly below the upper surfaces of rails 215, 217. Plungers 277 no longer act on the stack. Significant clearance is now present between the bent down sides of bag $B_1$ and the remaining stack above bag $B_1$ (bags $B_2 \ldots B_N$). At this stage, the next step is to raise elevator trucks 250 while the bent down sides of bag $B_1$ remain bent down.

Stage 4 (FIG. 13): Cylinder rods 259 of cylinders 258 have been retracted to raise elevator trucks 250 to their uppermost positions. Cylinders 274 and 277 remain deactivated. In raising the elevator trucks, their the forks have bypassed bag $B_1$ through the clearance provided in Stage 3 and, before being maximally raised to the position shown in FIG. 13, the forks have engaged the stack from below bag $B_2$ and have raised bags $B_2 \ldots B_N$ away from rails 215, 217 and bag $B_1$. A depleted stack of bags $B_2 \ldots B_N$ thereby has been defined. After the stack has been engaged from below bag $B_2$ by the forks of the elevator trucks, the suction applied to bag $B_1$ by suction cups 271 has been released leaving bag $B_1$ to rest freely atop rails 215, 217 without its opposed sides being bent downwardly. At this stage, the next step is to remove bag $B_1$.

Stage 5 (FIG. 14): The only difference between this stage and Stage 4 is that bag $B_1$ is no longer present. It has been removed from the magazine chamber while the depleted stack of bags $B_2 \ldots B_N$ remained raised.

Following Stage 5, cylinder rods 259 of cylinders 258 are then fully extended. This action returns elevator trucks 250 to their lowermost positions. In so doing, depleted stack $B_2 \ldots B_N$ lowers to seat on rails 215, 217. A new cycle of operation may begin and may continue until the original stack is completely depleted.

Bag Removal Mechanism

The mechanism for removing bags from chamber 200 comprises a feed mechanism generally designated 280 for feeding a lowermost bag such as bag $B_1$ when in the position shown in FIG. 13 (and also FIG. 4) along rails 215, 217 to an outlet opening provided by rearward end 202 of chamber 200. The bag removal mechanism further comprises means for conveying the lowermost bag through the outlet opening.

More particularly, rails 215, 217 extend longitudinally from within chamber 200 beneath rearward end 202, and for a short distance thereafter to upper and lower cooperating rollers for rotationally grasping and drawing a bag through the outlet opening (see FIGS. 2 and 4). Beneath rearward end 202 and above upper surfaces 216, 218 of the rails, there is clearance to allow passage of the bag being fed.

Figure 16:
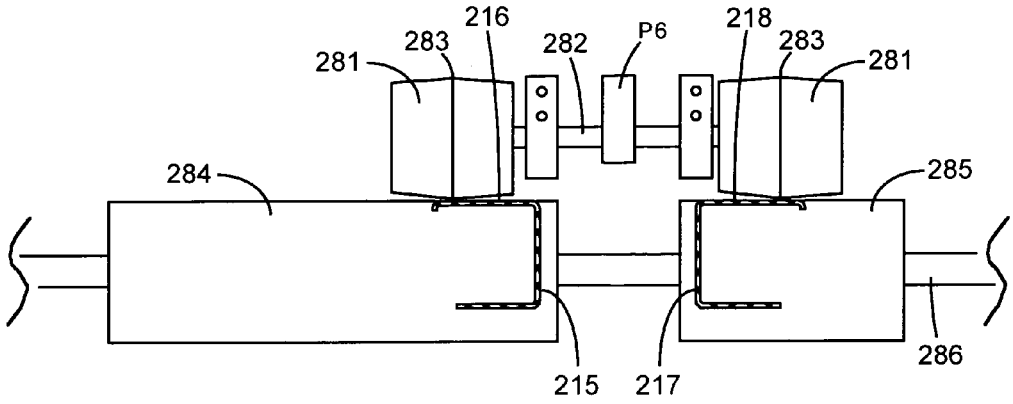
FIG. 16 is a front elevation view of upper and lower rollers towards which bags are moved for removal from the magazine chamber shown in FIGS. 1-4.

As best seen in FIG. 16, the rollers comprise two upper rollers 281 which are freely rotatable on shaft 282, and two lower rollers 284, 285 which are secured to and rotate with rotation of shaft 286. Shaft 286 is driven by a motor 287 which is controlled by means of a motor controller 288 (shown only in FIG. 24). Controller 288 is in turn controlled by a programmable logic controller PLC (shown only in FIG. 24). Note that rollers 281 are crowned at 283 to provide a pinching action which better ensures that bags can be reliably grasped by rollers 281, 284, 285 and drawn through the outlet opening. Note also that the length of roller 284 as seen in FIG. 16 is about twice that of roller 285. If side 203 as shown in FIG. 2 is moved to the left to accommodate bags having a larger width, then rail 215 which is mounted to side 203 also will be moved to the left. In FIG. 16, rail 215 likewise will be moved to the left. This maintains registration with a bag being discharged from chamber 200.

The rollers are not run continuously. In this regard, the bag removal mechanism includes a proximity sensor P6 (see FIGS. 3, 16 and 24) for detecting the presence of a bag such as bag $B_1$ when it has been successfully fed to a point where it may be grasped by the rollers. When presence is detected, the rollers are then engaged by the operation of motor 287.

Feed mechanism 280 comprises a suction cup 290 which is linearly moveable left to right from the position shown in FIG. 4 and, as best seen in FIGS. 10-14, which is moveable upwardly and downwardly to grip the underside of a lowermost bag seated on rails 215, 217 when suction is applied. More particularly, for up and down movement, suction cup 290 is pivotally mounted at the end of a pivot arm 291 controlled by a pneumatic cylinder 292, the latter of which is depicted only in FIG. 24. In turn, for left to right linear movement, pivot arm 291 and cylinder 292 are mounted by mount 293 to the cylinder rod of a pneumatic cylinder 294.

The operation of the bag removal mechanism as follows. At Stage 1 (FIG. 10) described above, suction cup 290 as shown in FIG. 10 in a downward position below bag $B_1$. Then, at Stage 2 (FIG. 11) described above, suction cup 290 has been pivoted upwardly on pivot arm 291 by activation of cylinder 292 to engage the underside of bag $B_1$ between rails 215, 217. The upward position is maintained during Stages 3 and 4 described above with suction being applied by suction cup 290. At Stage 4 (FIG. 13), with bags $B_2 \ldots B_N$ now lifted away and the suction applied by suction cup 290 continuing to grip bag $B_1$, cylinder 294 is activated, its cylinder rod extends. Bag $B_1$ is linearly fed along rails 215, 217 towards rollers 281, 284, 285. When the presence of bag $B_1$ at the rollers is detected by sensor P6 the suction applied by suction cup 290 is released. Bag $B_1$ is then free to be grasped and removed from the magazine chamber (as depicted in FIG. 14) upon operation the rollers. Subsequently, cylinders 292 and 294 are deactivated and a new cycle of operation may begin from Stage 1 (FIG. 10).

Bag Transfer Station

Bags removed from magazine assembly 20 may be handled in various ways, the ultimate objective being to transport them in sequence to a bag filling station. In principle, the job could be done by a worker manually grasping each bag as it leaves the chamber and carrying it by hand to the bag filling station. The same may be done by various automated means.

However, in a preferred embodiment, a bag transfer station 30 as shown in FIGS. 1-4 and which works in combination with magazine assembly 20 is positioned to receive bags removed from the assembly and to convey them to a pick-up position on the station. The station comprises a conveyor belt 301 which runs on axles 302, 303 and which is driven by motor 287 when roller shaft 286 is driven. The pick-up position is defined by side-wall guides 305, 306 and by an end stop 307. For the purpose of illustration, the right hand side of FIG. 4 shows in broken outline of bag $B_1$ when in its pick-up position on station 30. Further movement to the right in FIG. 4 is constrained by stop 307. Transverse movement is constrained by guides 305, 306.

Note that guide 306 is linked to side 203 of magazine assembly 20. If the distance between sides 203 and 204 of assembly 20 is adjusted to accommodate differently sized bags, then the distance between guides 305 and 306 of transfer station 30 will be correspondingly adjusted.

To better ensure that a bag conveyed by conveyor belt 301 is reliably conveyed to the desired pick-up position, transfer station 30 includes a longitudinally restraining member or band 310 and a transversely extending restraining member or band 311. Here, the problem which is being addressed is that some bags, unless restrained, may undesirably lift and carry over side-wall guide 305 or 306, or may undesirably bounce back from end stop 307.

The distal end of station 30 includes a grated structure 330. This structure is not considered essential, but it is desirable. The purpose is to allow passage of particulate material which may otherwise accumulate at the distal end.

Transfer station 30 includes a proximity sensor P7 for detecting when a bag is in the pick-up position. When presence is detected, the operation of motor 287 is stopped on command from motor controller 287 thereby stopping the operation of conveyor belt 301 and rollers 281, 284, 285. Station 30 also includes a suction cup 320 for momentarily holding the bag at the pick-up position when it is picked up in the manner now to be described.

System Structure

Figures 24, 25:
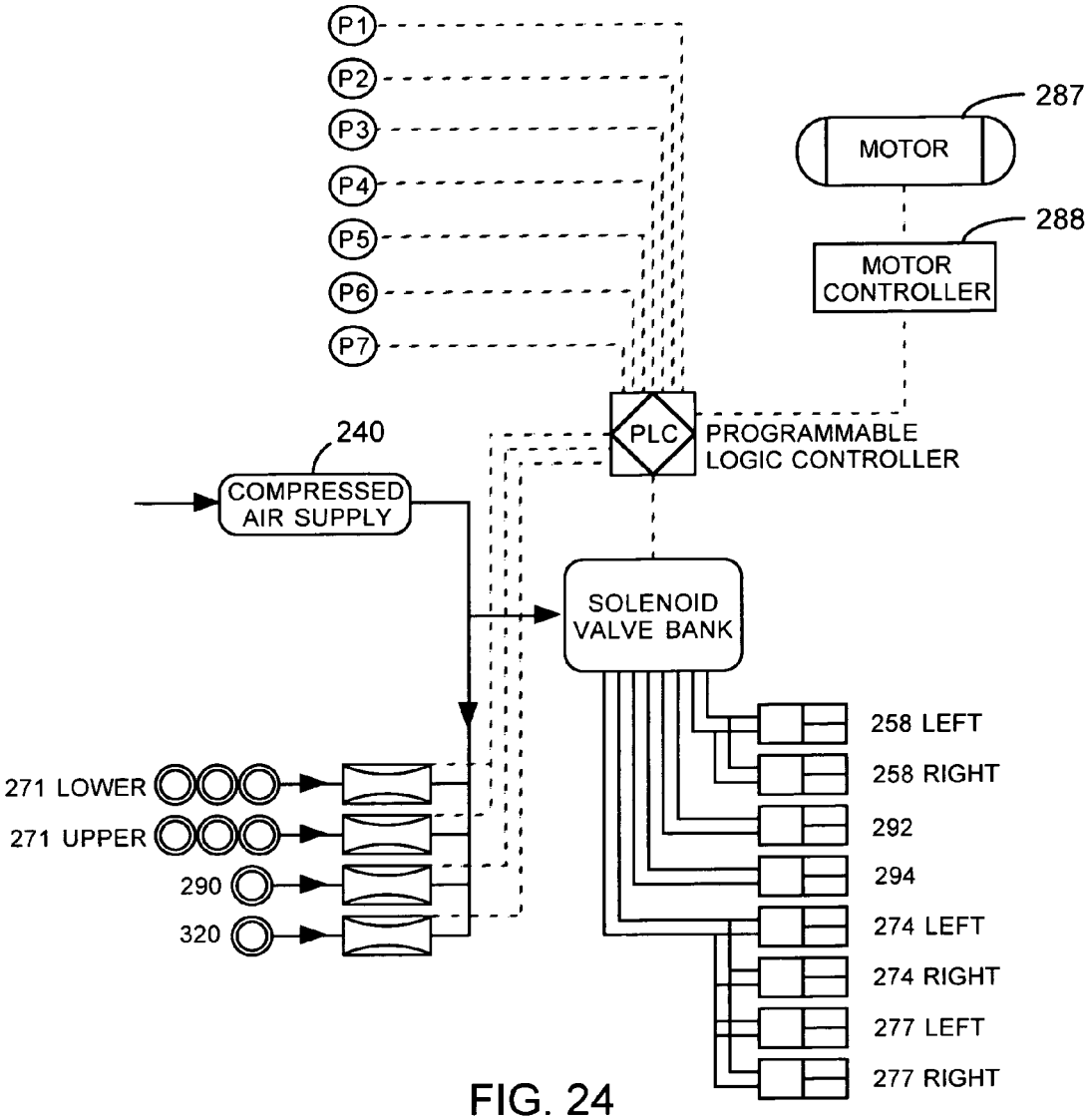
FIG. 24 is system diagram showing various air line and electrical connections used in the operation of the apparatus shown in FIGS. 1-4.
FIG. 25 is a legend for various symbols used in FIG. 24.

Referring now to FIGS. 24 and 25, the central control for operation the apparatus shown in FIGS. 1-4 is the PLC mentioned above. It receives electrical inputs from proximity sensors P1 to P7 and provides properly sequenced electrical outputs to motor controller 288 as described above, a solenoid valve bank, and four vacuum generators, the latter of which controllably apply suction as described above to the following suction cups from compressed air supply 240:

the three lower suction cups 271 as shown in FIG. 4 and, concurrently, the three upper suction cups as shown in FIG. 4;

suction cups 290 and 320 as may also be seen in FIG. 4.

The function of the proximity sensors is as follows:

Sensor P1: to detect when cylinder rod 259 as shown on the left hand side in FIGS. 10-14 is extended.

Sensor P2: to detect when cylinder rod 259 as shown on the left hand side in FIGS. 10-14 is retracted.

Sensor P3: to detect when cylinder rod 259 as shown on the right hand side in FIGS. 10-14 is extended.

Sensor P4: to detect when cylinder rod 259 as shown on the right hand side in FIGS. 10-14 is retracted.

Sensor P5: to detect when pivot arm 291 as shown in a FIG. 4 is in a downward position (meaning that suction cup 290 will be in a downward position as shown in FIG. 10.

Sensor P6: for detecting when a bag has been fed to a point where it may be grasped by rollers 281, 284, 285 as described above.

Sensor P7: described above.

The physical positions of sensors P1 to P5 are not illustrated in the drawings. However, suitable placement will be readily apparent to those skilled in the art.

The solenoid valve bank receives compressed air from supply 240 as an input and, under the control of the PLC, appropriately routes the air as required to pneumatic cylinders 258, 274, 292, 294 and plungers/cylinders 277. In FIG. 24, the labels LEFT and RIGHT are references to the positions where the element appear as seen in FIGS. 10-13.

Transport to Filling Station

Figure 17:
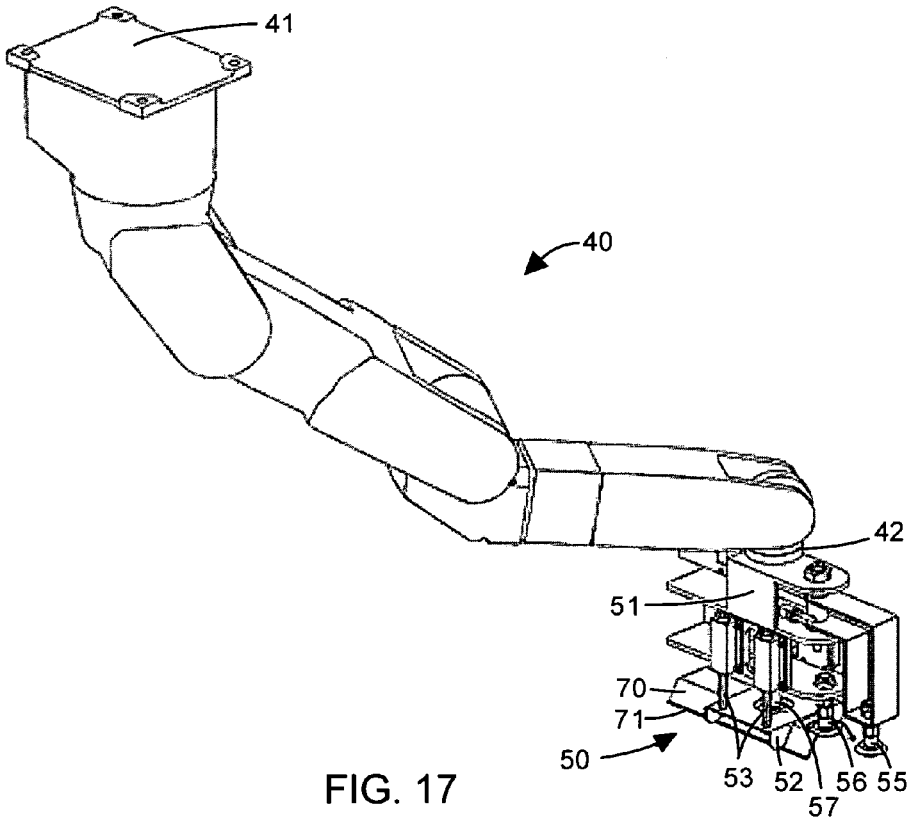
FIG. 17 is a perspective view of a bag carrying tool mounted at the end of robotic arm for picking up valve bags from the transfer station shown in FIGS. 1-4 and carrying them to a bag filling station such as the filling station representationally shown in FIG. 9.
Figure 18:
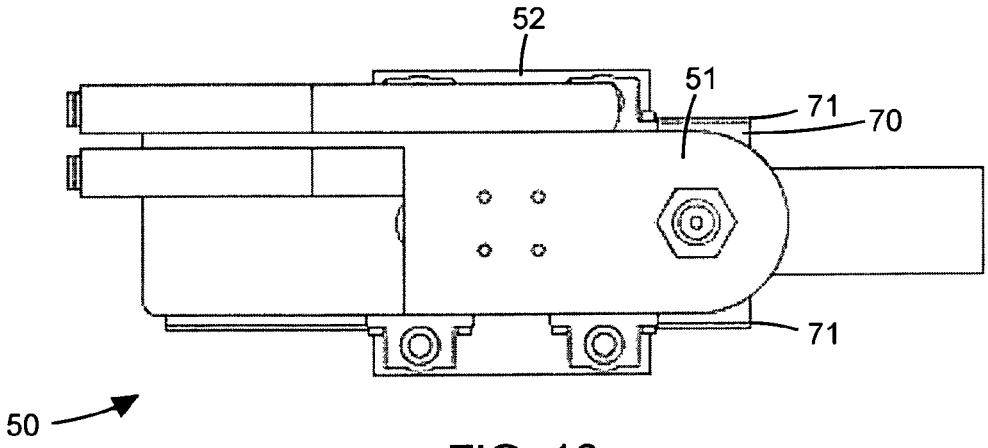
FIG. 18 is a top view of the carrying tool shown in FIG. 17.
Figure 19:
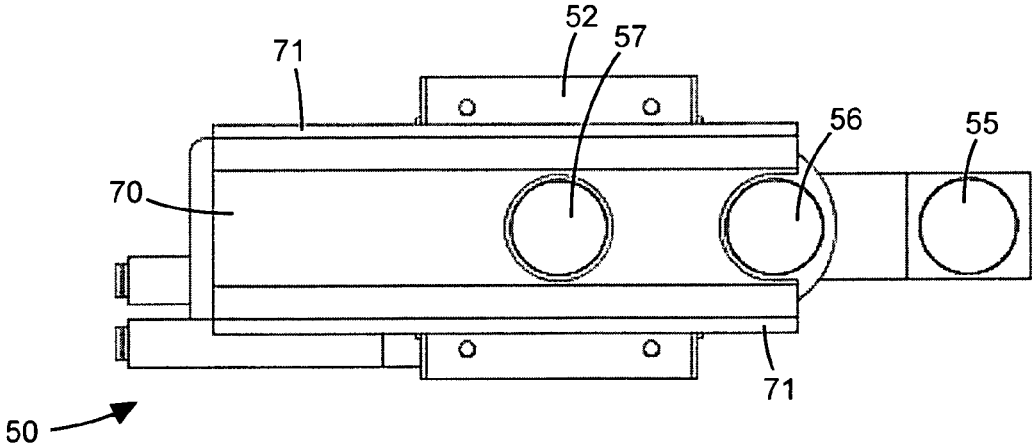
FIG. 19 is a bottom view of the carrying tool shown in FIG. 17.
Figure 20:
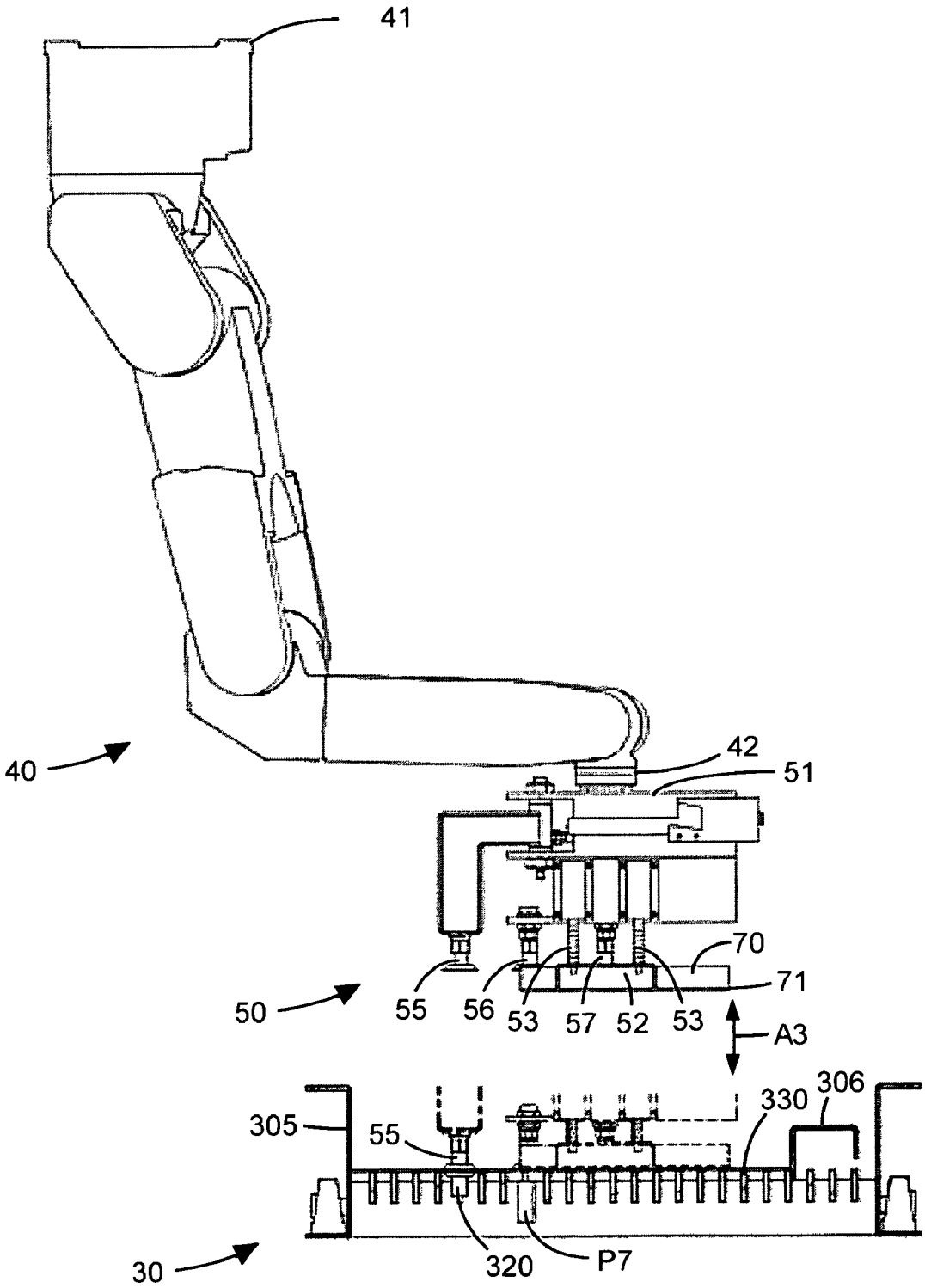
FIG. 20 is a side elevation view of the robotic arm and carrying tool shown in FIG. 17, the carrying tool being shown in an upper position above the transfer station shown in FIGS. 1-4 and a lowermost position for picking up a valve bag from the station.

Referring now to FIGS. 17-23, there is shown in FIGS. 17 and 20 a conventional robotic arm generally designated 40 having a proximal end 41 and a distal end 42. The proximal end is held by a support (not shown). A bag carrying tool generally designated 50 is mounted to the distal end. For the purpose of clarity, the robotic arm is not depicted in FIGS. 18-19 and 21-23, but it will be assumed that tool remains mounted to the arm.

Arm 40 is programmable and has several degrees of freedom. At the distal end, carrying tool 50 can be lifted and lowered, rotated on a vertical axis (e.g. compare FIGS. 17 and 20) and/or on a horizontal tilt axis (e.g. compare FIGS. 22 and 23), and generally carried along any trajectory path within reach of the arm. In the present case, the reach extends from transfer station 30 as shown in FIG. 20 to bag filling station 9 as shown in FIGS. 22-23.

FIG. 20 illustrates carrying tool 50 in two positions: firstly, in an upper position above transfer station 30 and, secondly, in broken outline and partially cut-away, a lowermost position atop station 30 for picking up a valve bag which is in a pick-up position. Upward and downward directional movement is controlled by robot arm 40 is and indicated by arrow line A3.

Figure 21:
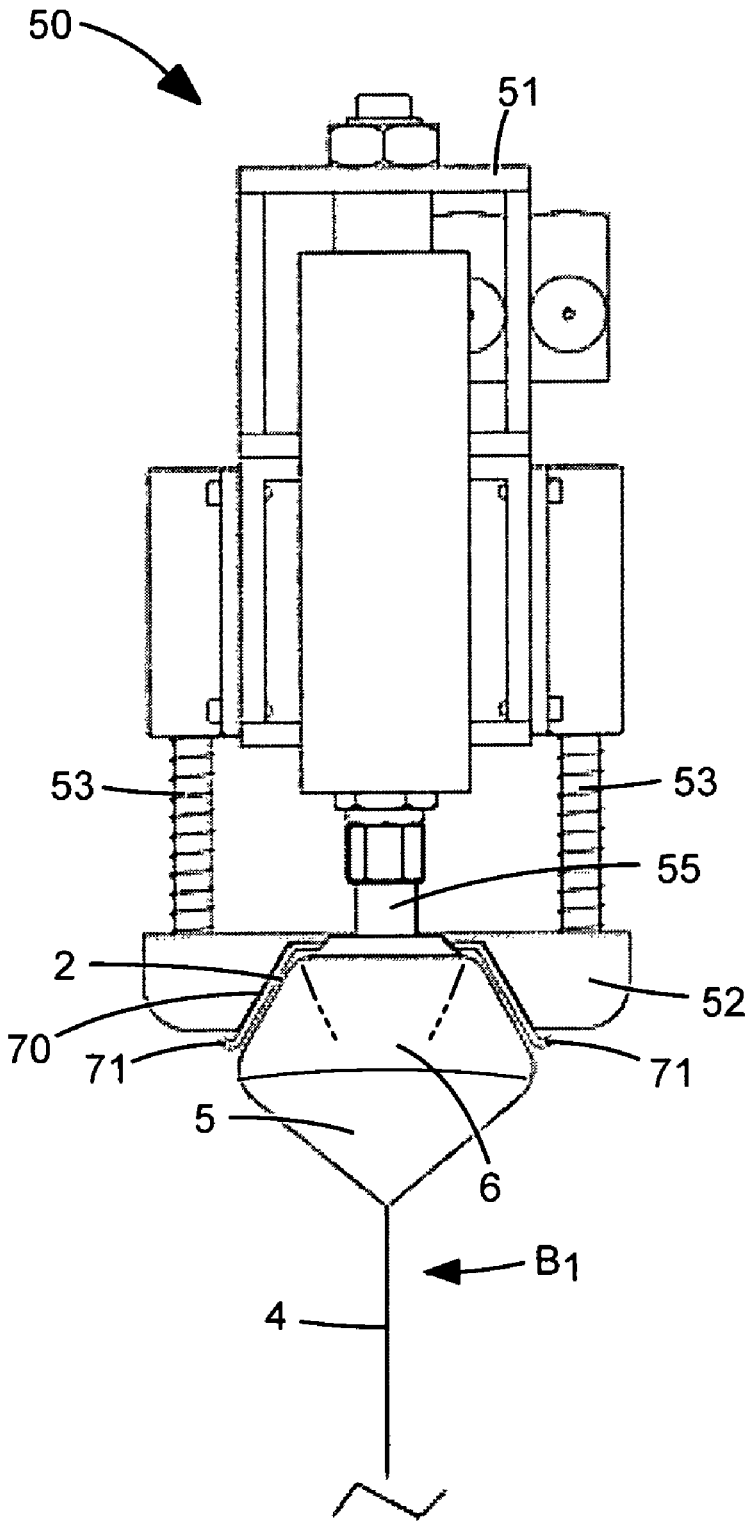
FIG. 21 is an end view of the carrying tool while carrying a valve bag with its valve fully open.

FIG. 21 illustrates valve bag $B_1$ when picked up by tool 50 and with its valve entrance 6 fully open.

Figure 22:
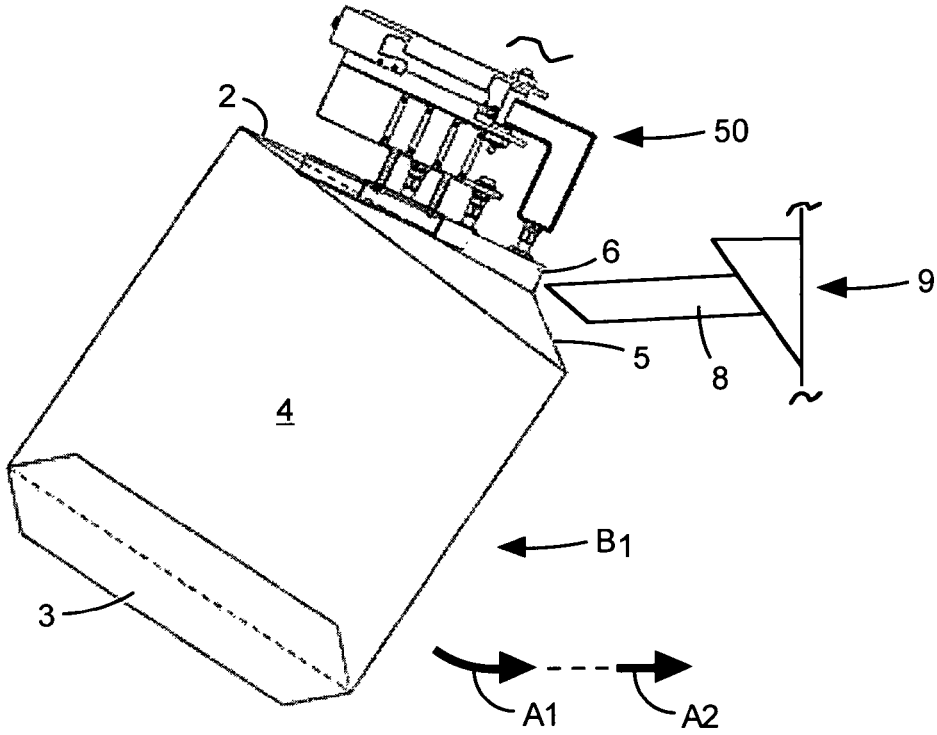
FIG. 22 is a side elevation view illustrating the carrying tool carrying a valve bag towards the nozzle of the filling station shown in FIG. 9 at a significant angle of tilt.
Figure 23:
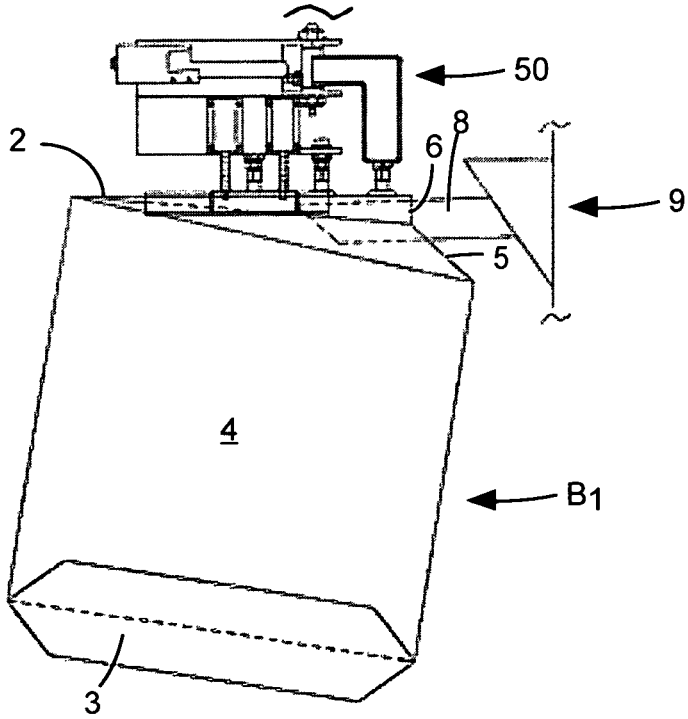
FIG. 23 is a side elevation illustrating the bag carrying tool and valve bag shown in FIG. 22, the carrying tool now having positioned the bag on the filling station nozzle.

In FIG. 22, bag $B_1$ is shown being carried by tool 50 at a significant clockwise or forward angle of tilt towards nozzle 8 of filling station 9. Then, when the bag reaches the nozzle, it is rotated anti-clockwise with a wrist-like movement as indicated by arrow A1 and slid forwardly over the nozzle as indicated by arrow A2 to the position shown in FIG. 23. Tilting permits a substantial part of lip 5 of valved end 2 of the bag to be engaged by the nozzle when the bag first reaches the nozzle. Coupled with the wrist-like movement, this has been found to better ensure that the bag will be successfully placed on the nozzle in the event that valve entrance 6 has for reason not been fully opened. The pressure applied by the nozzle on lip 5 can serve to open valve entrance 6 if it is only partially open. In contrast, if bag $B_1$ is first introduced to nozzle 8 with the orientation shown in FIG. 23 and without significant tilt, then there is greater risk that a partially open valve entrance will not be properly engaged by the nozzle.

In more detail, carrying tool 50 comprises several elements including an upper supporting framework 51 and a lower base structure 52, the latter of which carries a valve shaping channel member 70 defined by an elongated top and opposed sides extending downwardly and outwardly from the top to an open bottom. Base structure 52 is spring-mounted to framework 51 by means of compression springs 53. Further, tool 50 includes three suction cups 55, 56, 57. Pneumatic connections to the suction cups are not shown.

When a bag such as bag $B_1$ is being carried by tool 50, then as best seen in FIG. 21 the upper portion of its valved end 2 has generally adopted the shape defined by the top and sides of channel member 70. As is also best seen in FIG. 21, the sides of channel member 70 are provided with outwardly extending curvate flanges 71. Their purpose is to provide a smooth entrance when the valved end of a bag is engaged and drawn upwardly into the channel member where it is held open by the action of suction cups 55, 56, 57. The shaping feature provided by channel member 70 is considered desirable because it tends to widen the area of openness of lip 5 and entrance 6 to a valved end.

When preparing to pick up a bag such as bag $B_1$ from transfer station 30, robot arm 40 first performs an alignment operation. Channel member 70 is oriented to extend lengthwise over the flat-folded valved end of the bag. Suction cups 55, 56, 57 are all positioned over the valved end, suction cup 55 being in axial alignment with suction cup 320. When robot arm 40 then directs tool 50 from the upper position shown in FIG. 20 to the lower position shown in FIG. 20, channel member 70, cushioned by springs 53 is urged against the valved end of the bag. Suction is then applied to suction cups 55, 56, 57 and momentarily to suction cup 320. The effect of the momentary suction applied by cup 320 is to hold the bag downwardly while the valved end of the bag is being drawn upwardly into channel member 70. This better ensures that a valved end will not be drawn into channel 70 with its valve entrance closed or only partially opened when the bag is lifted away by the action of robot arm 40.

Although the present invention has been shown and described in considerable detail, it should be understood by those skilled in the art that we do not intend to limit the invention to the embodiments described since various modifications, omissions and additions may be made to the disclosed embodiments without materially departing from the novel teachings and advantages of the invention. The intention is to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures.

We claim:

1. A method of handling empty, flat folded storage bags in preparation for filling with a flowable material, each bag having opposed ends and opposed sides extending between said ends, said method comprising:

(a) seating and stacking a plurality of said bags on a fixed elevation base within a chamber of a bag holding magazine assembly, the resulting stack defining an initial stack rising from a lowermost one of said bags on said base to an uppermost one of said bags;

(b) then, raising within said chamber away from said base all but the lowermost bag, the raised bags defining a depleted stack of bags;

(c) then, while the depleted stack remains raised, removing the lowermost bag from said chamber through a chamber outlet opening;

(d) then, lowering the depleted stack to seat a new lowermost bag on said base; and, (e) then, repeating steps (b) to (d) for each new lowermost bag.

2. A method as described in claim 1, wherein each lowermost bag removed from said chamber is removed by:

(a) feeding the bag to the outlet opening in the chamber; and, (b) conveying the bag through said outlet opening to a bag pick-up position located away from the magazine assembly.

3. A method as described in claim 1, wherein each lowermost bag removed from said chamber is removed by conveyance through the outlet opening in the chamber to a pick-up position located on a bag transfer station, said method further comprising:

(i) automatically lifting the bag away from said pick-up position; and, (ii) automatically carrying the lifted bag to a bag filling station for filling with said flowable material.

4. A method as described in claim 1, wherein each of said bags is a valve bag having an openable flat-folded filling valve at one of its said ends, and wherein each lowermost bag removed from said chamber is removed with its valved end first.

5. A method as described in claim 2, wherein each of said bags is a valve bag having an openable flat-folded filling valve at one of its said ends, and wherein each lowermost bag removed from said chamber is removed with its valved end first.

6. A method as described in claim 3, wherein each of said bags is a valve bag having an openable flat-folded filling valve at one of its said ends, and wherein each lowermost bag removed from said chamber is removed with its valved end first.

7. A method as described in claim 6, said method further comprising opening said filling valve of each bag at said pick-up position before carrying the bag to said filling station.

8. A method as described in claim 7, wherein said filling valve of each bag is opened by applying an upward suction grip to a top surface of the valve while momentarily holding the bag at said pick-up position.

9. A method as described in claim 8, wherein said suction grip draws and holds the valved end of the bag in a valve shaping channel member of a bag carrying tool with the filling valve remaining open, said channel member comprising an elongated top and opposed sides extending downwardly and outwardly from said top to an open bottom; and wherein said grip is maintained while carrying the lifted bag to said bag filling station.

10. A method as described in claim 9, wherein said bag filling station comprises a filling nozzle where each bag is held for filling with said flowable material.

11. A method as described in claim 10, wherein said carrying tool introduces the filling valve of each bag to said filling nozzle at a significant forward angle of tilt, then pivots the bag with a wrist-like movement to reduce the angle of tilt while sliding the valve forwardly over the nozzle.

12. A method as described in claim 7, wherein said valve of each bag is opened by applying upward suction to a top surface of the valve while momentarily holding the bag at said pick-up position with downward suction applied to an opposed underside region of the bag.

13. A method as described in claim 1, wherein said chamber extends front to back between a chamber forward end and a chamber rearward end, and transversely between opposed chamber sides, and wherein each lowermost bag removed from said chamber is removed through the outlet opening in said rearward end.

14. A method as described in claim 13, wherein there is an adjustable distance between said chamber sides, said method further comprising as part of step (a) in claim 1:

adjusting said distance to an amount limiting transverse movement of bags stacked within the chamber without impairing removal of the lowermost bag from the chamber through said outlet opening.

15. A method as described in claim 13, wherein each lowermost bag removed from said chamber is removed by:

(a) feeding the bag to said outlet opening; and, (b) conveying the bag through said outlet opening to a position away from the chamber.

16. A method as described in claim 15, wherein each bag is fed endwise to said outlet opening and is conveyed endwise through said outlet opening.

17. A method as described in claim 16, wherein said base comprises a pair of spaced apart rails extending longitudinally between said forward end and said rearward end of said chamber, each rail having an upper surface forming part of the upper surface of said base, said method further comprising as part of step (b) in claim 1:

gripping and downwardly bending the opposed sides of the lowermost bag below the rail upper surfaces before raising all but the lowermost bag, then releasing such grip prior to step (c) in claim 1.

18. A method as described in claim 17, wherein said grip is a suction grip.

19. A method as described in claim 17, wherein each lowermost bag fed to said outlet opening is fed by:

gripping the bag in a region between said rails and moving the bag on said rails to said outlet opening, then releasing such grip prior to conveying the bag through said outlet opening.

20. A method as described in claim 19, wherein said grip between said rails is a suction grip.

21. A method as described in claim 20, wherein each lowermost bag conveyed away from said chamber is conveyed to a pick-up position located on a bag transfer station, said method further comprising:

(a) automatically picking up each removed bag from said pick-up position; and, (b) automatically carrying each picked up bag to a bag filling station for filling with said flowable material.

22. A method as defined in claim 1, wherein said bags are stacked between opposed sides of said chamber in successive groups of bags with back and forth longitudinal staggering between said groups.

23. A magazine assembly for handling and sequentially supplying bags from a stack of empty, flat folded storage bags in preparation for filling with a flowable material, each bag having opposed ends and opposed sides extending between said ends, and each bag having opposed top and bottom surfaces between said ends, said stack extending upwardly from a lowermost one of said bags to an uppermost one of said bags, said magazine assembly comprising:

(a) a chamber for holding said stack, said chamber extending front to back between a forward end of the chamber and a rearward end of the chamber, and transversely between opposed sides of the chamber, said rearward end providing an outlet opening permitting removal of bags in said stack from the chamber through said outlet opening;

(b) a fixed elevation base having an upper surface for providing a seating for said stack within said chamber with said lowermost bag resting on said base; said surface being aligned with said outlet opening;

(c) an elevator mechanism for selectively raising within said chamber all but said lowermost bag while holding the lowermost bag on said base, the raised bags defining a depleted stack of bags, and for lowering and seating said depleted stack on said base when said lowermost bag has been removed from said chamber; and, (d) a bag removal mechanism for removing said lowermost bag from said chamber through said outlet opening while said depleted stack remains raised.

24. Apparatus as defined in claim 23, wherein said chamber sides are distanced from each other by an adjustable amount.

25. Apparatus as defined in claim 23, wherein said elevator mechanism comprises:

(a) a pair of elevator guides, one positioned outside one side of said chamber, the other positioned outside the opposite side of said chamber;

(b) a pair of elevator trucks each having a forward end comprising a plurality of lifting forks positioned between opposed sides of the truck, said trucks being carried and guided by respective ones of said guides for reciprocal movement in unison between lower positions where said forks are distanced away from said chamber and upper positions where said forks project into said chamber;

(c) gripper mechanisms for gripping and downwardly bending the opposed sides of said lowermost bag when said bag is rested on said base;

said elevator mechanism being disposed such that as said trucks move upwardly from said lower positions to said upper positions when the opposed sides of the lowermost bag are bent downwardly, then said forks bypass said lowermost bag and engage said stack below the bag next above the lowermost bag, such engagement occurring before said trucks reach maximally upward positions.

26. Apparatus as defined in claim 25, wherein each of said forks projects inwardly relative to said chamber at a downward angle.

27. Apparatus as defined in claim 26, wherein said angle is about 6 degrees.

28. Apparatus as defined in claim 25, wherein said forks on each truck have lengths which vary from relatively short lengths for those ones of said forks positioned towards opposed sides of the truck to longer lengths for those ones of said forks positioned midway between said sides.

29. Apparatus as defined in claim 28, wherein each of said forks projects inwardly relative to said chamber at a downward angle.

30. Apparatus as defined in claim 25, wherein said trucks are guided to travel along said guides at angle of about 35 degrees relative to the upper surface of said base.

31. Apparatus as defined in claim 30, wherein each of said forks projects inwardly relative to said chamber at a downward angle.

32. Apparatus as defined in claim 25, wherein said gripper mechanisms comprise:

(a) a first plurality of pivotally mounted suction cups for releasably applying suction grips at a first plurality of locations on the bottom surface of one side of the said lowermost bag; and, (b) a second plurality of pivotally mounted suction cups for concurrently releasably applying suction grips at a second plurality of locations on the bottom surface of the opposed side of said lowermost bag.

33. Apparatus as defined in claim 32, further including:

(a) a first plurality of plungers actionable on said stack for momentarily urging the bottom surface of the lowermost bag against said first plurality of suction cups when suction is applied; and, (b) a second plurality of plungers simultaneously actionable on said stack for momentarily urging the bottom surface of the lowermost bag against said second plurality of suction cups when suction is applied.

34. Apparatus as defined in claim 23, wherein said base comprises a pair of longitudinally extending rails, each rail having an upper surface forming part of the upper surface of said base, and wherein said bag removal mechanism comprises:

(a) a feed mechanism for feeding said lowermost bag along said rails to said outlet opening; and, (b) means for conveying said lowermost bag through said outlet opening.

35. Apparatus as defined in claim 34, wherein said means for conveying said lowermost bag through said outlet opening comprises upper and lower cooperating rollers for rotationally grasping and drawing said bag through said outlet opening.

36. Apparatus as defined in claim 35, wherein said upper rollers are crowned pinch rollers.

37. Apparatus for handling and sequentially supplying bags from a stack of empty, flat folded storage bags in preparation for filling with a flowable material, each bag having opposed ends and opposed sides extending between said ends, each bag having opposed top and bottom surfaces between said ends, said stack extending upwardly from a lowermost one of said bags to an uppermost one of said bags, said apparatus comprising:

(a) a magazine assembly as defined in claim 23;

(b) a bag transfer station for receiving each lowermost bag removed from said magazine assembly through said outlet opening and for conveying the received bag to a pick-up position on said station.

38. Apparatus as defined in claim 37, wherein each of said bags is a valve bag having an openable flat-folded filling valve at one of its said ends, said apparatus further including means for automatically picking up each removed bag from said pick-up position and for automatically transporting each picked up bag to a bag filling station for filling with said flowable material.

39. Apparatus as defined in claim 38, wherein said means comprises a robotic arm having a distal end and a bag carrying tool mounted at said distal end.

40. Apparatus as defined in claim 39, wherein said transfer station and said carrying tool are adapted to cooperatively open said valve when the bag is picked up from the transfer station using said robotic arm.

41. Apparatus as defined in claim 40, wherein said carrying tool comprises a valve shaping channel member into which the valved end of each of said bags is drawn and held when picked up from said transfer station, said channel member comprising an elongated top and opposed sides extending downwardly and outwardly from said top to an open bottom.

* * * * *